US007460677B1

(12) United States Patent
Soede et al.

(10) Patent No.: US 7,460,677 B1
(45) Date of Patent: Dec. 2, 2008

(54) DIRECTIONAL MICROPHONE ARRAY SYSTEM

(75) Inventors: Willem Soede, Leiden (NL); Robert B. Schulein, Evanston, IL (US); Norman P. Matzen, Campbell, CA (US); Roland Horsten, Delft (NL)

(73) Assignee: Etymotic Research Inc., Elk Grove Village, IL (US)

( * ) Notice: Subject to any disclaimer, the term of this patent is extended or adjusted under 35 U.S.C. 154(b) by 0 days.

(21) Appl. No.: 09/517,848

(22) Filed: Mar. 2, 2000

Related U.S. Application Data

(60) Provisional application No. 60/123,004, filed on Mar. 5, 1999.

(51) Int. Cl.
*H04R 3/00* (2006.01)
*H04R 1/02* (2006.01)

(52) U.S. Cl. ..... 381/92; 381/91; 381/122

(58) Field of Classification Search ..... 381/91, 381/92, 98, 101, 102, 104, 107, 120, 313, 381/356, 122, 95
See application file for complete search history.

(56) References Cited

U.S. PATENT DOCUMENTS 4,118,604 A * 10/1978 Yanick ..... 381/320
4,510,459 A * 4/1985 Guisinger ..... 330/265
4,521,908 A * 6/1985 Miyaji et al. ..... 381/92
4,553,108 A * 11/1985 Young ..... 330/300
4,888,807 A * 12/1989 Reichel ..... 381/92
5,524,056 A 6/1996 Killion et al.
5,657,393 A 8/1997 Crow
5,793,875 A 8/1998 Lehr et al.
5,805,147 A * 9/1998 Tokioka et al. ..... 345/173
5,847,621 A 12/1998 Gutierrez
5,905,692 A 5/1999 Dolazza et al.
6,049,607 A 4/2000 Marash et al.
7,031,483 B2 * 4/2006 Boone et al. ..... 381/313

FOREIGN PATENT DOCUMENTS

JP 59-41995 9/1982
JP 59-41995 * 3/1984

OTHER PUBLICATIONS

"Improvement of Speech Intelligibility in Noise: Development and Evaluation of a New Directional Hearing Instrument Based on Array Technology" Ph.D. Thesis, Delft University of Technology, Delft, The Netherlands, 1990.
"Etymotic Research—D-MIC 2ND Order Directional Progress: As of Apr. 27, 1994".

* cited by examiner

*Primary Examiner*—Xu Mei
(74) *Attorney, Agent, or Firm*—McAndrews, Held & Malloy, Ltd.

(57) ABSTRACT

A directional microphone array system generally for hearing aid applications is disclosed. The system may employ a broadside or an endfire array of microphones. In either case, the signals generated by the microphone are added using a plurality of summation points that are connected together via a single signal wire or channel. In the case of the endfire array, all but one of the signals is delayed so that the summation of the signals are in phase. The summation of the signals is then used to generate an output signal for a speaker of a hearing aid or the like.

5 Claims, 29 Drawing Sheets c(f) = 1.1 + 0.3 log(f/1000)

DIRECTIONAL MICROPHONE ARRAY SYSTEM

CROSS-REFERENCE TO RELATED APPLICATIONS

This application makes reference to, and claims priority to, U.S. provisional application Ser. No. 60/123,004 filed Mar. 5, 1999.

INCORPORATION BY REFERENCE

The above-referenced U.S. provisional application Ser. No. 60/123,004 is hereby incorporated herein by reference in its entirety.

STATEMENT REGARDING FEDERALLY SPONSORED RESEARCH OR DEVELOPMENT

N/A

BACKGROUND OF THE INVENTION

Individuals with hearing loss typically experience great difficulty understanding speech in noisy environments. This is particularly true for an increasing number of elderly people, who often have difficulty carrying on a normal conversation in social situations, such as parties, meetings, sporting events or the like, involving a high level of background noise. Such hearing loss in noise is generally due to reduced hearing sensitivity of the ear, which results in an attenuation of all sounds and a distortion of sounds. In other words, reduced hearing sensitivity causes a listener to perceive speech to be not only softer, but also garbled.

Hearing aids are known and have been developed to assist individuals with hearing loss. Hearing aids generally amplify sounds, and thus compensate for the attenuation effect of reduced hearing sensitivity. However, it is the distortion effect, i.e., the inability of a listener to discriminate between sounds, that makes speech intelligibility in noise difficult, or even impossible, for most people. A solution to improve speech intelligibility in noise, therefore, must compensate for the distortion effect by attenuating background noise in relation to desired speech signals. In fact, several investigations on speech intelligibility in noise have demonstrated that every 4-5 dB attenuation of background noise may raise speech intelligibility by about 50%.

Directional microphones have been used in hearing aids to attenuate background noise. A suitable measure of the directional effect of such a microphone is the directivity index. The directivity index indicates in decibels the amount in which a directional microphone attenuates sounds in a diffuse sound field as compared to an omnidirectional microphone. In the frequency range most important for speech discrimination (i.e., about 500 to 5000 Hz), the directivity index for a typical $1^{st}$ order directional microphone is only approximately 5 dB. This level of directivity at such frequencies, while an improvement for individuals with mild to moderate hearing loss is insufficient for situations involving more severe loss.

As a result, the use of several directional microphones was proposed by an inventor in the present application for improving the directivity of a hearing aid and thus speech intelligibility under such conditions of noise and hearing loss. See Soede, Willem, "Improvement of Speech Intelligibility in Noise: Development and Evaluation of a New Directional Hearing Instrument Based on Array Technology" Ph.D. Thesis, Delft University of Technology, Delft, The Netherlands, 1990, which is incorporated herein by reference in its entirety (referenced hereinafter as "the Delft Thesis"). The Delft Thesis proposed that traditional microphone array techniques already of use in other fields, such as astronomy, sonar, radar and seismology, could be used in hearing aid applications to improve directional characteristics.

One such traditional microphone array is shown in FIG. 1*a*. A microphone array system 2 includes a plurality of microphones 4 aligned along an axis x. Each microphone 4 generates a signal from a desired sound typically impinging along an axis y, as well as from undesired sounds from all directions, and each signal generated is transmitted to a processor 6. Each processed signal is then added to produce an amplified output signal 10. Such a microphone array is generally referred to as a "broadside" array.

Another such traditional microphone array is shown in FIG. 1*b*. A microphone array system 1 includes a plurality of microphones 3 aligned with equal spacing along an axis z. Sound impinges on each of the microphones 3 along the z-axis as shown by arrow 5. Each signal generated by the respective microphones is then transmitted to a processing block 7. Depending on the location of a particular microphone 3 along the z-axis, the processing block 7 may apply a delay to the received signal.

More specifically, for the first microphone, the signal (labeled $m_4$) is delayed four delay periods 8; for the second (labeled $m_3$), the signal is delayed three delay periods 8; for the third (labeled $m_2$), the signal is delayed two delay periods 8; for the fourth (labeled $m_1$), the signal is delayed one delay period 8; and for the last microphone (labeled $m_0$), the signal is not delayed at all. Applying a delay as such ensures that the signals received along an axis z are in phase and thus in condition for maximum summation. Once the signals are in phase, each signal is processed using a processor 9, and then all signals are summed to produce an output signal 11.

For sound impinging on the microphone array system 1 at an angle shown by arrow 5, the total delay period ($\tau_m$) for any given processing block 7 in FIG. 1*b* can be calculated using the following formula:

$$\tau_m = \frac{m\Delta z}{c},\ m = 0, 1, 2, 3\ldots$$

where m represents the microphone 3 number, $\Delta z$ the distance between the microphones 3, and c the velocity of sound. Each equal delay period 8 can thus be calculated as $\tau_m/m$ or $\Delta z/c$.

In addition, the number of delay periods 8 for any given number of microphones in an array can be calculated using the following formula:

$$\frac{n(n-1)}{2}$$

where n is the number of microphones in the array. Thus, for the array in FIG. 1 having five microphones, 10 delay periods 8 are required.

The operation of the microphone array system 1 of FIG. 1*b* can be demonstrated graphically as shown in FIG. 2. Each microphone 3 generates a signal 13 from impinging sound energy at a particular time along an axis t. Each generated signal 13, except for the last one corresponding to microphone $m_0$, is delayed a period tau ($\tau$) as discussed above so that the delayed signals 13 are in phase. The signals 13 are then added to produce an output signal 15 (corresponding to signal 11 in FIG. 1). Because the same delay period τ is applied to all sound received from a direction to the rear of the microphone array, the resulting summed signal received from rear sounds is out of phase (see signal 17). What results, therefore, is an amplified signal with a preference for all sounds coming from the front of the array. In other words, the array achieves a much higher directivity than is possible with the use of only a single microphone 3. An array of microphones of the type discussed above with respect to FIGS. 1*b* and 2 above is generally referred to as an "endfire" array.

In the 1930's, Hansen and Woodyard, working with large arrays (approximately 10 times the wavelength) in radar applications, derived a formula mathematically for optimizing the directivity of such endfire arrays. The Delft Thesis mentioned above applied the Hansen and Woodyard principle to acoustics and determined that the time delay τ set forth above can be optimized using the following formula:

$$\tau_m = \frac{m\Delta z}{c}(1+\varepsilon), \text{ with } \varepsilon = \frac{2.94\lambda}{2\pi L} = \frac{2.94c}{2\pi fL}$$

where λ equals the sound wavelength, L equals the array length, and f equals the sound frequency. This mathematical Hansen-Woodyard optimization for endfire arrays set forth in the Delft Thesis is plotted in FIG. 3 (as directivity index versus frequency—see curve 19). The traditional approach (i.e., prior to optimization) is also shown in FIG. 3 as curve 18. The mathematical Hansen-Woodyard optimization is further plotted in FIG. 4 (as delay time versus frequency—see curve 21). The traditional approach (i.e., prior to optimization) is also shown in FIG. 4 as curve 20.

In implementing a microphone array system to match the mathematical Hansen-Woodyard optimization, however, the Delft Thesis fell short of achieving such optimization (see curves 23 and 25 in FIGS. 3 and 4, respectively). Over a frequency range of approximately 250 to 6000 Hz, the Delft Thesis produced an average directivity index of approximately 8.1 dB. While this was an improvement over the traditional approach (which yielded an articulation index weighted directivity index ("AIDI") of approximately 6.7 dB), the Delft Thesis simply did not match the AIDI of 10.2 dB achieved by the mathematical Hansen-Woodyard optimization.

Thus, it is an object of the present invention to provide a microphone array system that more clearly matches the mathematical Hansen-Woodyard optimization.

It is a further object of the present invention to provide a miniature microphone array system more suitable than traditional arrays for hearing aid applications.

It is yet a further object of the invention to provide a new directivity optimization for short endfire microphone arrays.

BRIEF SUMMARY OF THE INVENTION

These and other objects of the invention are achieved in a microphone system having a plurality of microphones and a plurality of summation points. The plurality of microphones generate a plurality of electrical signals that are added by the plurality of summation points to generate an output signal. The plurality of summation points are electrically connected together via a single wire or signal channel.

In one embodiment, the microphone system also has a plurality of delay cells for delaying all but one of the electrical signals so that the signals are in phase with the one electrical signal that is not delayed. Each of the delay cells may also have an amplifier for amplifying the delayed signals. The delay cells may delay the electrical signals an equal time period, and in one embodiment may comprise a simple emitter-follower. The delay cells may also include an amplifier, such as, for example, a buffering high impedance fixed gain amplifier.

In another embodiment, the plurality of summation points comprise a plurality of resistors, one for each of the microphones. The resistors may be, for example, of equal value.

The microphone system may also have an output stage that amplifies the plurality of summed electrical signals, and a filter that compensates for the frequency response of the microphones. The system may further have a control system that enables the user to select the directivity of the system. In other words, the user can select the number of microphones to be used by the system, depending on the environment. The control system may be, for example, a zoom selector or a discrete switch. In addition, the control system may enable the user to control the volume of the output signal, depending on the number of microphones selected. The control system may have, for example, a gain control for this purpose.

These and other advantages and novel features of the present invention, as well as details of an illustrated embodiment thereof, will be more fully understood from the following description and drawings.

BRIEF DESCRIPTION OF THE SEVERAL VIEWS OF THE DRAWING

FIG. 7A shows circuitry for one embodiment of the delay cells of

DETAILED DESCRIPTION OF THE INVENTION

Figure 5:
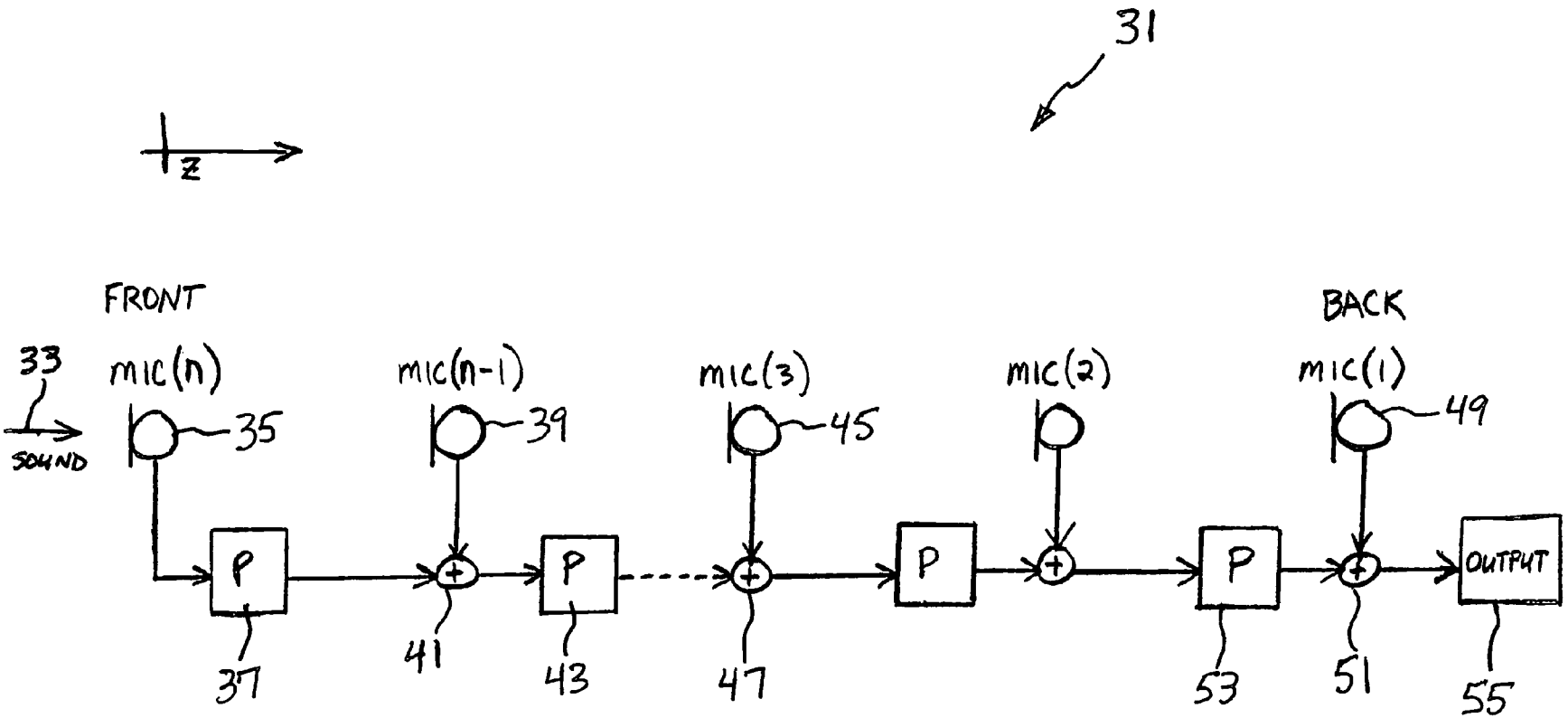
FIG. 5 is a block diagram of an endfire microphone array system according to the present invention.

FIG. 5 is a block diagram of an endfire microphone array system 31 according to the present invention. A plurality of microphones are equally spaced in an array along an axis z. Desired sound energy generally impinges on the microphones in a direction from front to back along the axis z as shown by arrow 33. Each microphone converts the sound energy into an electrical signal which, depending on the location of the microphone in the array, may be transmitted to a processing block for delay and processing. The signals are then added to produce an output.

More particularly, sound energy impinges on microphone 35, the first located along the array, which energy is converted into an electrical signal. The electrical signal is then delayed and processed by a processing block 37. The resulting signal, which is now in phase with the incoming signal generated by microphone 39, is added to that incoming signal at summation point 41. The added signal is then delayed and processed by a processing block 43. The resulting signal is now in phase with the incoming signal from microphone 45, and is added with that incoming signal at summation point 47. This process is repeated for all microphones in the array until a last microphone 49. The signal generated by the microphone 49 is simply added at summation point 51 to an output signal of processing block 53 to produce an output 55.

Figure 1A:
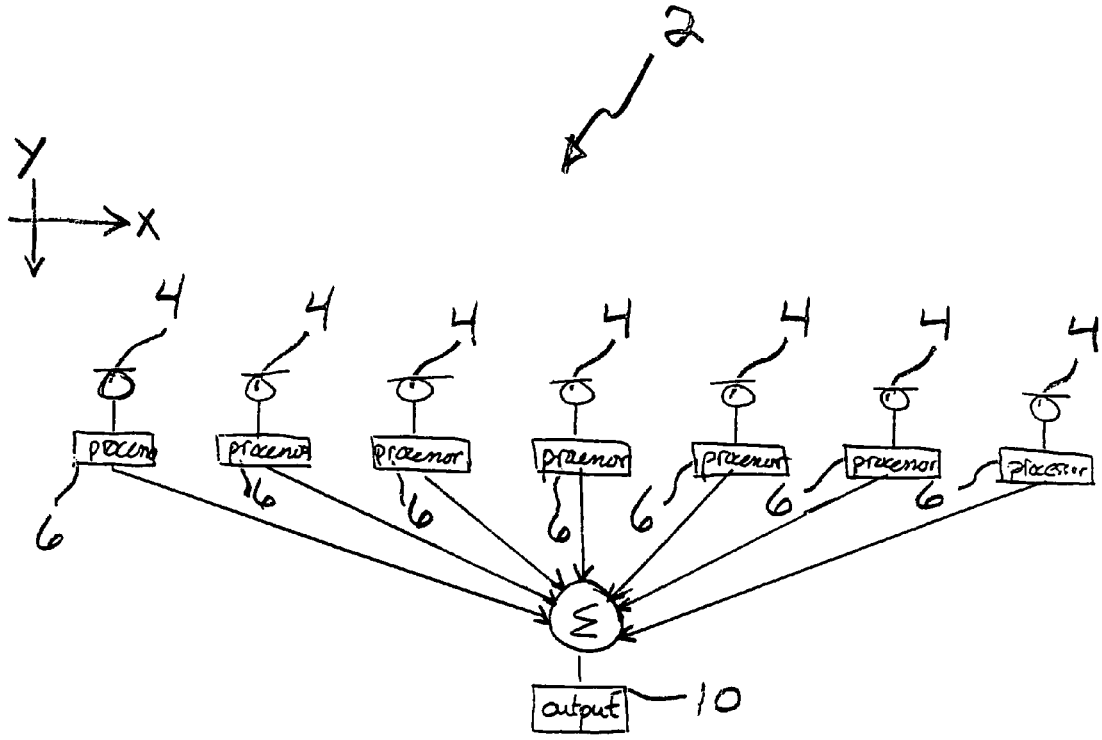
FIG. 1a (PRIOR ART)
FIG. 1*a* illustrates a traditional prior art broadside microphone array system.
Figure 1B:
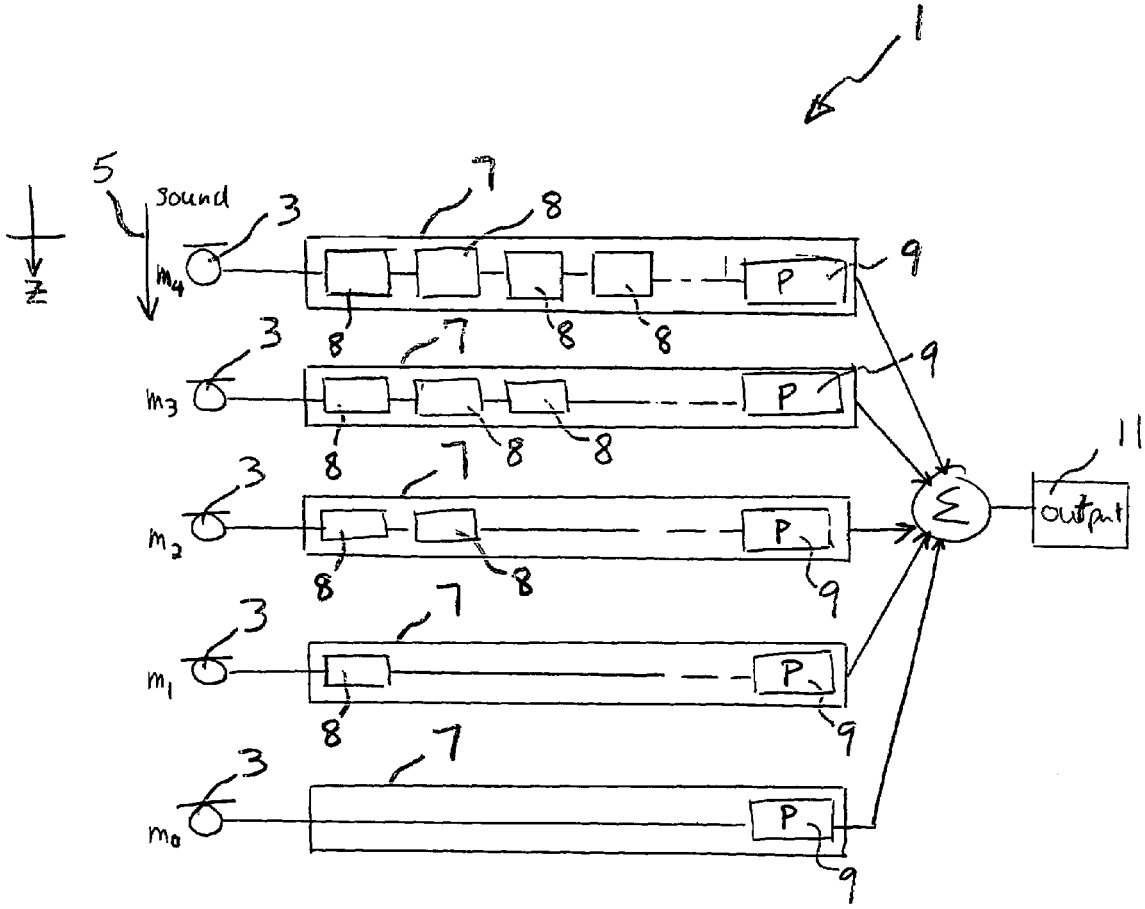
FIG. 1b (PRIOR ART)
FIG. 1*b* illustrates a traditional prior art endfire microphone array system.
Figure 2:
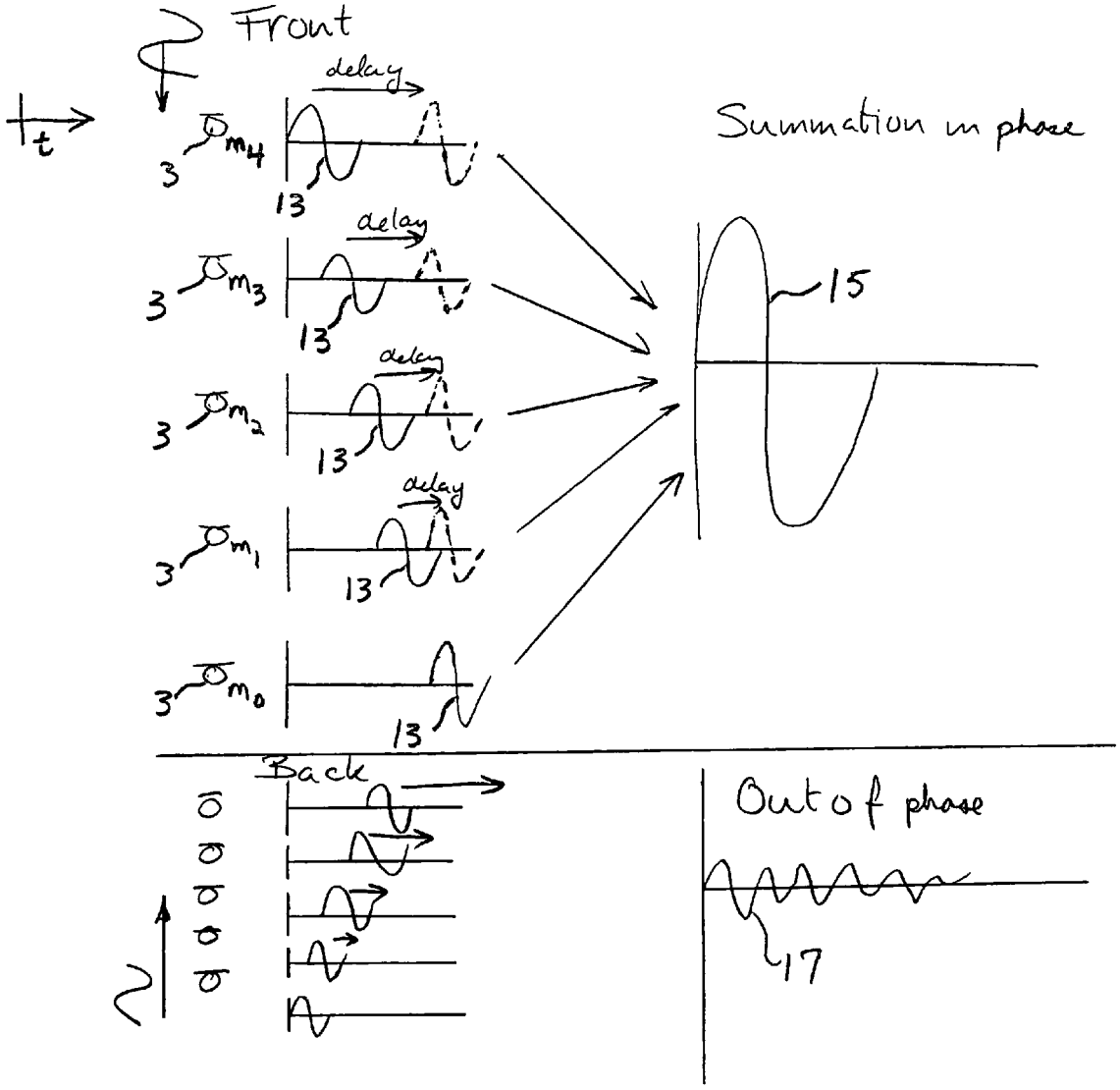
FIG. 2 (PRIOR ART)
FIG. 2 is a graphical representation of the functionality of the prior art endfire microphone array system of FIG. 1*b*.

The endfire microphone array system 31 of FIG. 5 is a substantial improvement over the prior art endfire array shown FIG. 1*b*. For example, the array system 31 of the present invention requires significantly less components and circuitry than that of the prior art. As mentioned above, for a five-microphone array, the prior art required five different signal wires or channels and ten delay components. In contrast, the array system 31 employing five microphones only requires one signal wire or channel and four delay components. This significant reduction in components makes the array system of the present invention smaller and therefore much more suitable for hearing aid applications in which small, discrete devices are desirable.

In addition, the prior art array required different processing for each microphone, since the delay $\tau$ used for each microphone was different. In contrast, the array system 31 of the present invention uses equal processors because each delay period is equal. In order to add microphones, therefore, the prior art system had to be completely re-wired. The present invention, on the other hand, enables a simple adding of an additional microphone and processing block onto the front of the array in a daisy chain manner. In other words, the array of the present invention can be expanded or contracted by simply adding or subtracting components.

Additionally, since different delays $\tau$ were required for each microphone of the prior art, timing optimization was required. In contrast, the present invention eliminates the need for such timing optimization since the components and circuitry are the same for each microphone.

Figure 6:
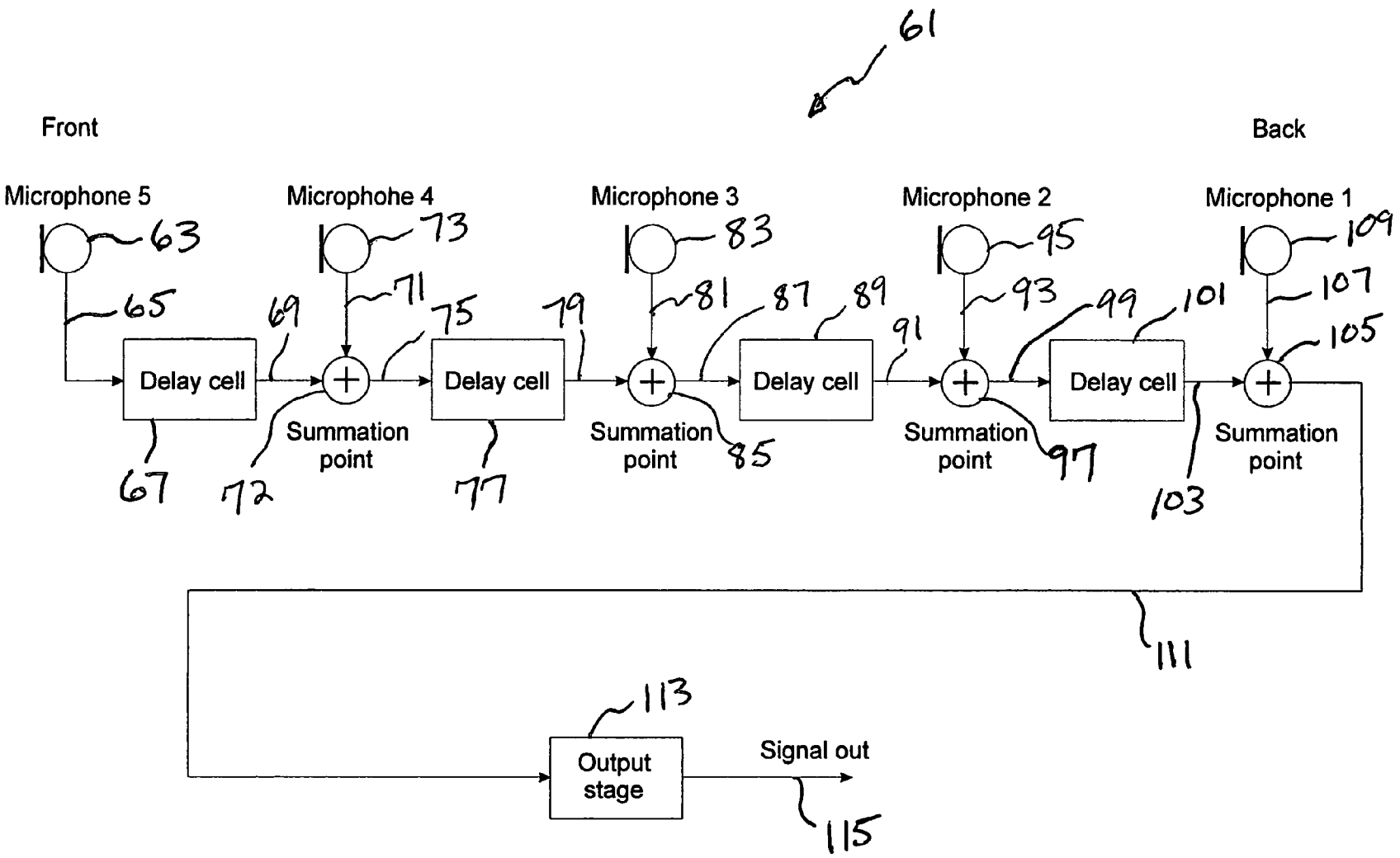
FIG. 6 is a block diagram of a five microphone end fire array system built in accordance with the present invention.

FIG. 6 is a block diagram of a five-microphone array assembly 61 built in accordance with the present invention. Sound energy impinging on microphone 63 is converted to an electrical signal 65, which is transmitted to delay cell 67. The delay cell 67 delays and amplifies the signal 65, and resulting signal 69 is added at a summation point 72 to signal 71 generated by microphone 73. Resulting signal 75 is then transmitted to delay cell 77 where again the signal 75 is delayed and amplified into resulting signal 79, which in turn is added at a summation point 85 to a signal 81 generated by microphone 83. Resulting signal 87 is then delayed and amplified by delay cell 89 into resulting signal 91, which is in turn added at a summation point 97 to signal 93 generated by microphone 95. Finally, resulting signal 99 is delayed and amplified by delay cell 101 into resulting signal 103, which is added at a summation point 105 to a signal 107 generated by microphone 109. Final resulting signal 111 is then transmitted to an output stage 113 for further processing to create an output signal 115.

Figure 7A:
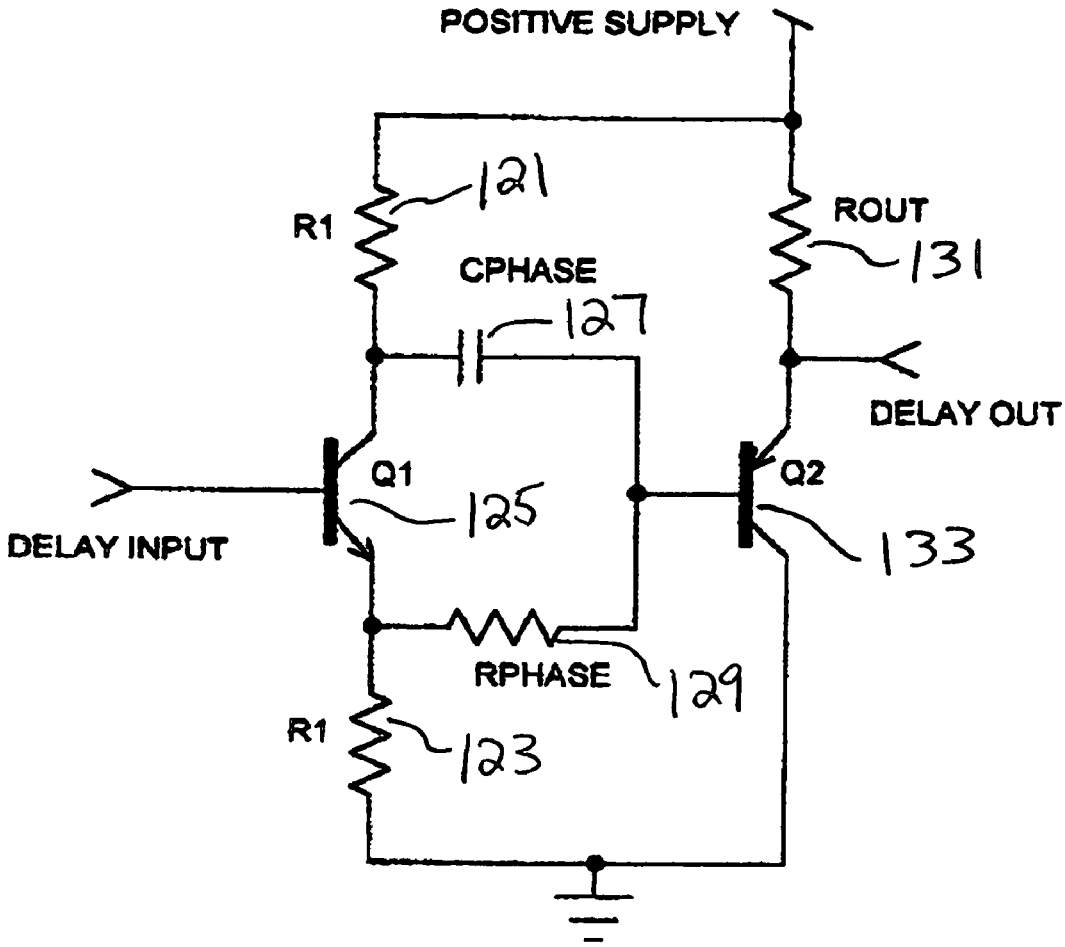

FIG. 7A shows circuitry for one embodiment of the delay cells of FIG. 6. Resistors 121 and 123, transistor 125, capacitor 127 and resistor 129 form a frequency dependent delay circuit, which performs the delay function discussed above with respect to FIG. 6. Resistor 131 and transistor 133 form a simple emitter-follower to keep a high impedance at the junction of capacitor 127 and resistor 129 of the frequency dependent delay circuit.

Figure 7B:
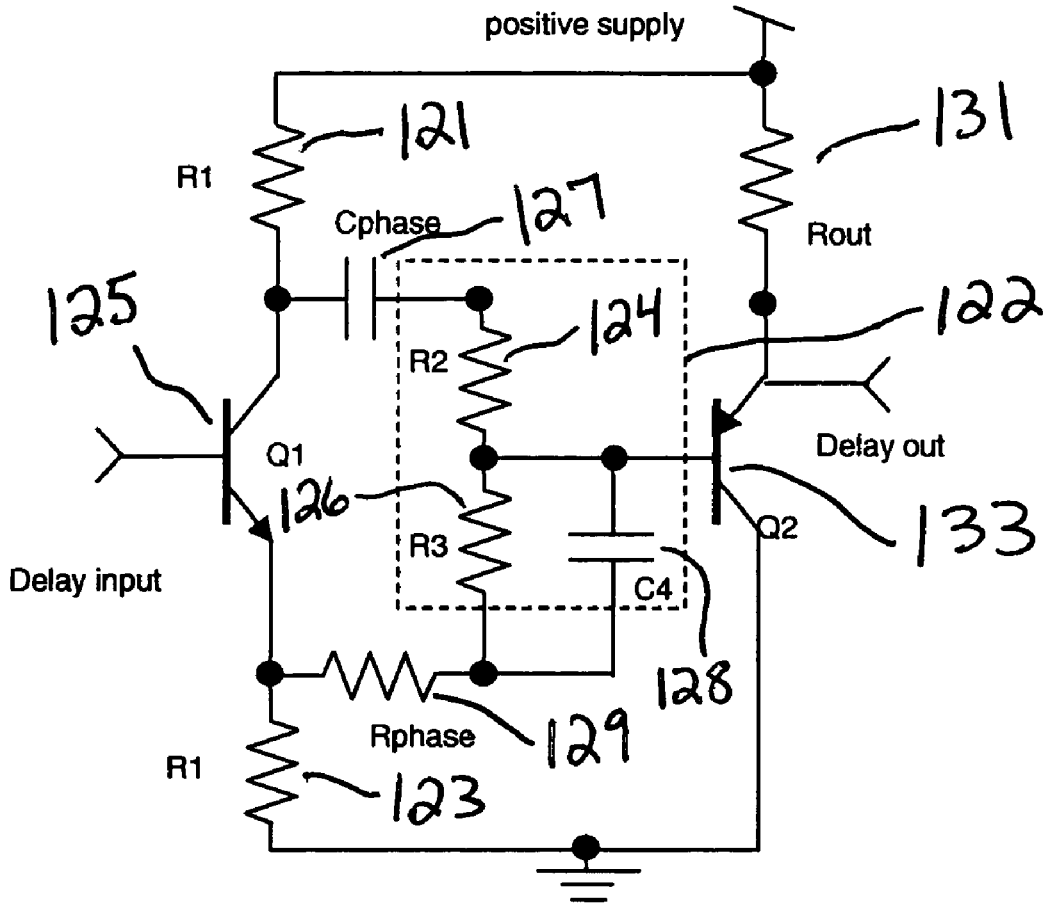
FIG. 7B shows circuitry for another embodiment of the delay cells of FIG. 6.

FIG. 7B shows circuitry for another embodiment of the delay cells of FIG. 6. As can be seen, the delay cell of FIG. 7B is the same as that shown in FIG. 7A, except that additional circuitry was added inside box 122. Specifically, resistors 124 and 126, and capacitor 128 were added as shown. These additional components, along with capacitor 127 (Cphase) and resistor 129 (Rphase), may have the following values in FIG. 7B:

TABLE I

| | Hansen-Woodyard | Wide-Range |
|---|---|---|
| Cphase | 1 nF | 1 nF |
| Rphase | 68 K | 82 K |
| R2 | 27 K | 2.2 K |
| R3 | 560 K | 100 K |
| C4 | 1.5 nF | 4.7 nF |

The circuitry of FIG. 7B provides for improved delay (i.e., greater) at low frequencies as compared to the circuitry of FIG. 7A. The values in the first column above result in a delay which approximate the theoretical Hansen-Woodyard optimization, but give a lower output level than that provided by the circuitry of FIG. 7A. These values may be used when the highest directivity at high and low frequencies is desired, and a lower output is acceptable.

The values in the second column above may be referred to as "wide-range," and provide optimum delay with a small change in output level as compared to the circuitry of FIG. 7A. The wide-range values provide a reasonable trade-off between low-frequency directivity and high output level.

As an alternative embodiment to that of FIG. 7B, resistor 124 (R2) may be removed, and resistor 126 (R3) may have the value of 820 K. Such a configuration provides acceptable results and saves circuit space.

Figure 8:
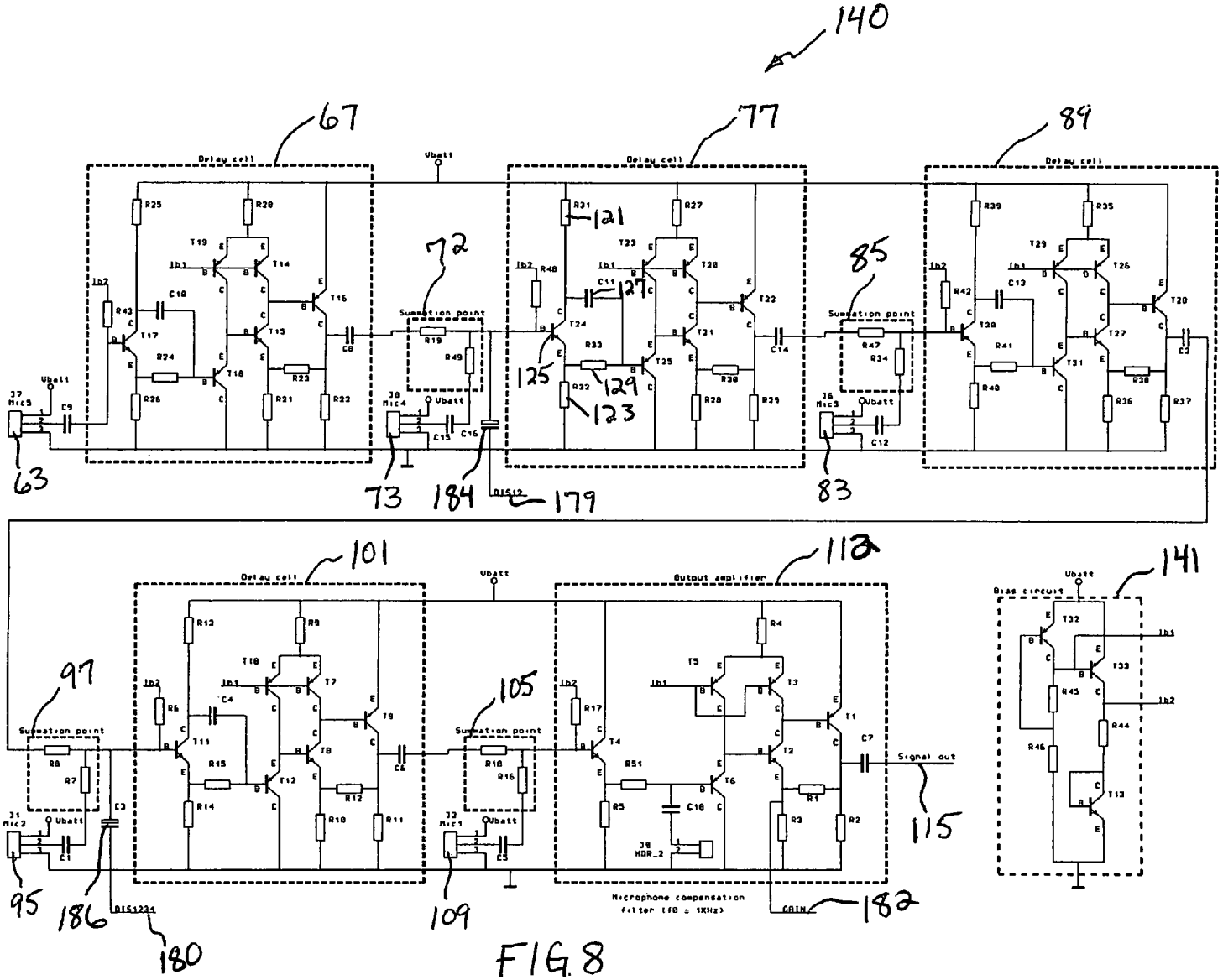
FIG. 8 illustrates detailed circuitry for one embodiment of the five microphone array assembly of FIG. 6 built in accordance with the present invention.

FIG. 8 illustrates detailed circuitry 140 for one embodiment of the five-microphone array assembly 61 of FIG. 6 built in accordance with the L present invention. As can be seen, FIG. 8 shows microphones 63, 73, 83, 95 and 109, delay cells 67, 77, 89, and 101, summation points 72, 85, 97, and 105, output stage 113 and output signal 115, all of FIG. 6. Output stage 113 is included as part of output cell 112. As mentioned above, each of the delay cells 67, 77, 89 and 101 are identical. The delay cells of FIG. 8, however, are somewhat different than the delay cell embodiments show in FIGS. 7A and 7B.

More specifically, referring to delay cell 77 of FIG. 8. Components 121, 123, 125, 127, and 129 corresponds to the frequency dependent delay circuit discussed above with respect to FIG. 7A. While only the components of FIG. 7A are specifically shown in FIG. 8, the delay cells of FIG. 8 may also incorporate the additional components of FIG. 7B rather than just those of FIG. 7A. The remainder of the delay cell components of FIG. 8, (i.e., five transistors and four resistors), however, form a more complex buffering high impedance fixed gain amplifier, which replaces the simple emitter-follower of FIGS. 7A and 7B. These additional components serve to maintain all direct current levels in the signal path to enable maximum signal swing for each delay cell.

As can be seen from FIG. 8, the final output cell 112 does not include the frequency dependent delay circuit found in the delay cells. Rather the components of the output cell 112 amplify, but do not delay, the input signal to create output signal 115. In addition to containing the output stage, the output cell 112 includes a microphone compensation filter, which compensates for the frequency response of the microphones. FIG. 8 also shows a bias circuit 141 that is connected to each one of the delay cells 67, 77, 89, and 101 as well as to the output cell 112. This circuit sets the bias currents of the delay cells and the output cell at approximate levels.

The following lists exemplary values for the circuitry components illustrated in FIG. 8:

| | |
|---|---|
| R43 | 2 MEG |
| C9 | 330 N |
| R25 | 33 K |
| R26 | 33 K |
| C10 | 1 N |
| R24 | 82 K |
| R20 | 2 K |
| R21 | 33 K |
| R23 | 6.8 K |
| R22 | 100 K |
| C8 | 330 N |
| R19 | 33 K |
| R49 | 30 K |
| C15 | 330 N |
| R48 | 2 MEG |
| C16 | 2.2 U |
| R31 | 33 K |
| R32 | 33 K |
| C11 | 1 N |
| R33 | 82 K |
| R27 | 2 K |
| R28 | 33 K |
| R30 | 47 K |
| R29 | 100 K |
| C14 | 330 N |
| R47 | 33 K |
| R34 | 30 K |
| C12 | 330 N |
| R42 | 2 MEG |
| R39 | 33 K |
| R40 | 33 K |
| C13 | 1 N |
| R41 | 82 K |
| R35 | 2 K |
| R36 | 33 K |
| R38 | 47 K |
| R37 | 100 K |
| C2 | 330 N |
| R8 | 33 K |
| R7 | 30 K |
| C1 | 330 N |
| R6 | 2 MEG |
| C3 | 2.2 U |
| R13 | 33 K |
| R14 | 33 K |
| C4 | 1 N |
| R15 | 82 K |
| R9 | 2 K |
| R10 | 33 K |
| R12 | 47 K |
| R11 | 100 K |
| C6 | 330 N |
| R18 | 33 K |
| R16 | 30 K |
| C5 | 330 N |
| R17 | 2 MEG |
| R5 | 33 K |
| R51 | 150 K |
| C18 | 1 N |
| R4 | 2 K |
| R3 | 33 K |
| R1 | 47 K |
| R2 | 100 K |
| C7 | 330 N |
| R45 | 1 K |
| R46 | 33 K |
| R44 | 33 K |
| T17 | BC550 B |
| T18 | BC560 B |
| T19 | BC560 B |
| T14 | BC560 B |
| T15 | BC550 B |
| T16 | BC560 B |
| T24 | BC550 B |
| T23 | BC560 B |
| T25 | BC560 B |
| T20 | BC560 B |
| T21 | BC550 B |
| T22 | BC560 B |

-continued

| | |
|---|---|
| T30 | BC550 B |
| T29 | BC560 B |
| T31 | BC560 B |
| T26 | BC560 B |
| T27 | BC550 B |
| T28 | BC560 B |
| T11 | BC550 B |
| T10 | BC560 B |
| T12 | BC560 B |
| T7 | BC560 B |
| T8 | BC550 B |
| T9 | BC560 B |
| T4 | BC550 B |
| T5 | BC560 B |
| T6 | BC560 B |
| T3 | BC560 B |
| T2 | BC550 B |
| T1 | BC560 B |
| T32 | BC560 B |
| T33 | BC560 B |
| T13 | BC550 B |

Figure 3:
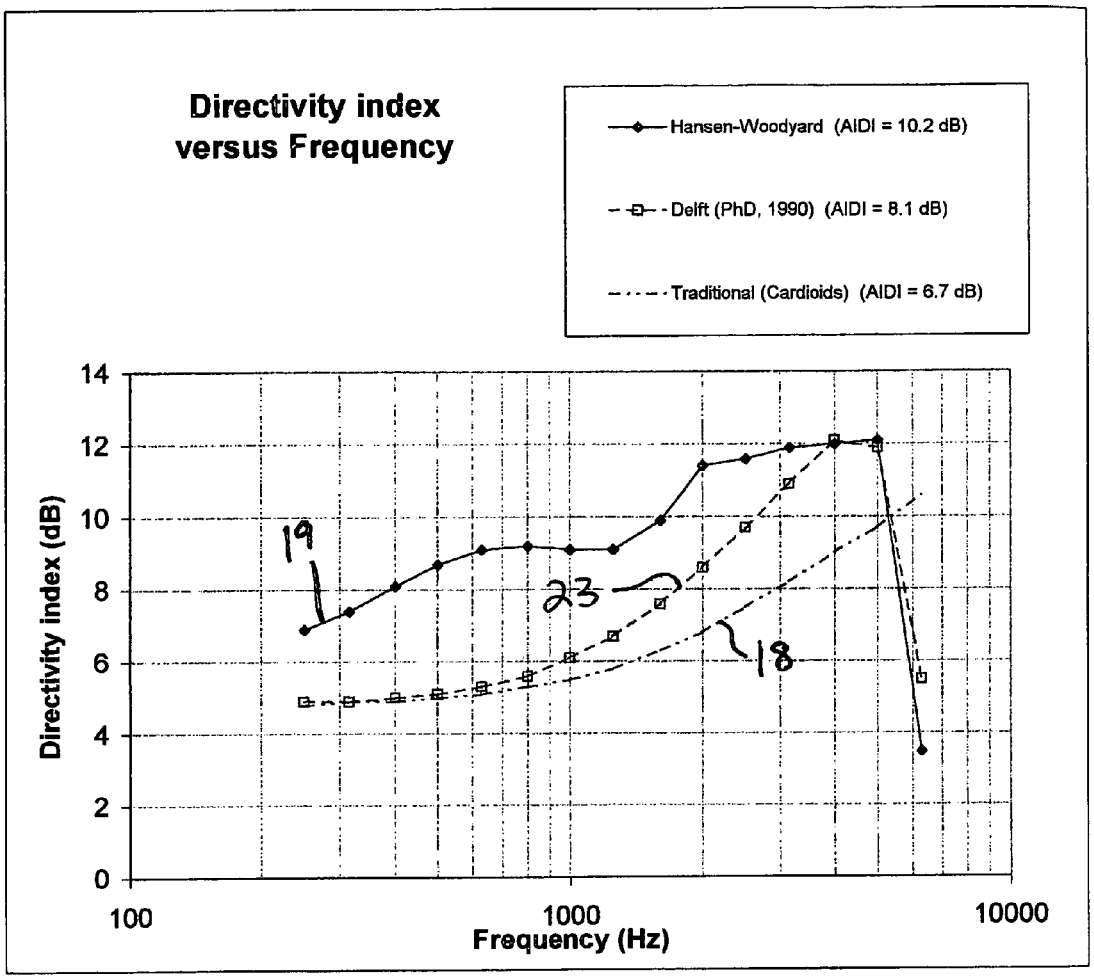
FIG. 3 (PRIOR ART)
FIG. 3 is a graphical plot of directivity versus frequency for a traditional prior art endfire array, a prior art implementation of the Hansen-Woodyard optimization for an endfire array, and the mathematical Hansen-Woodyard optimization for large endfire arrays.
Figure 9A:
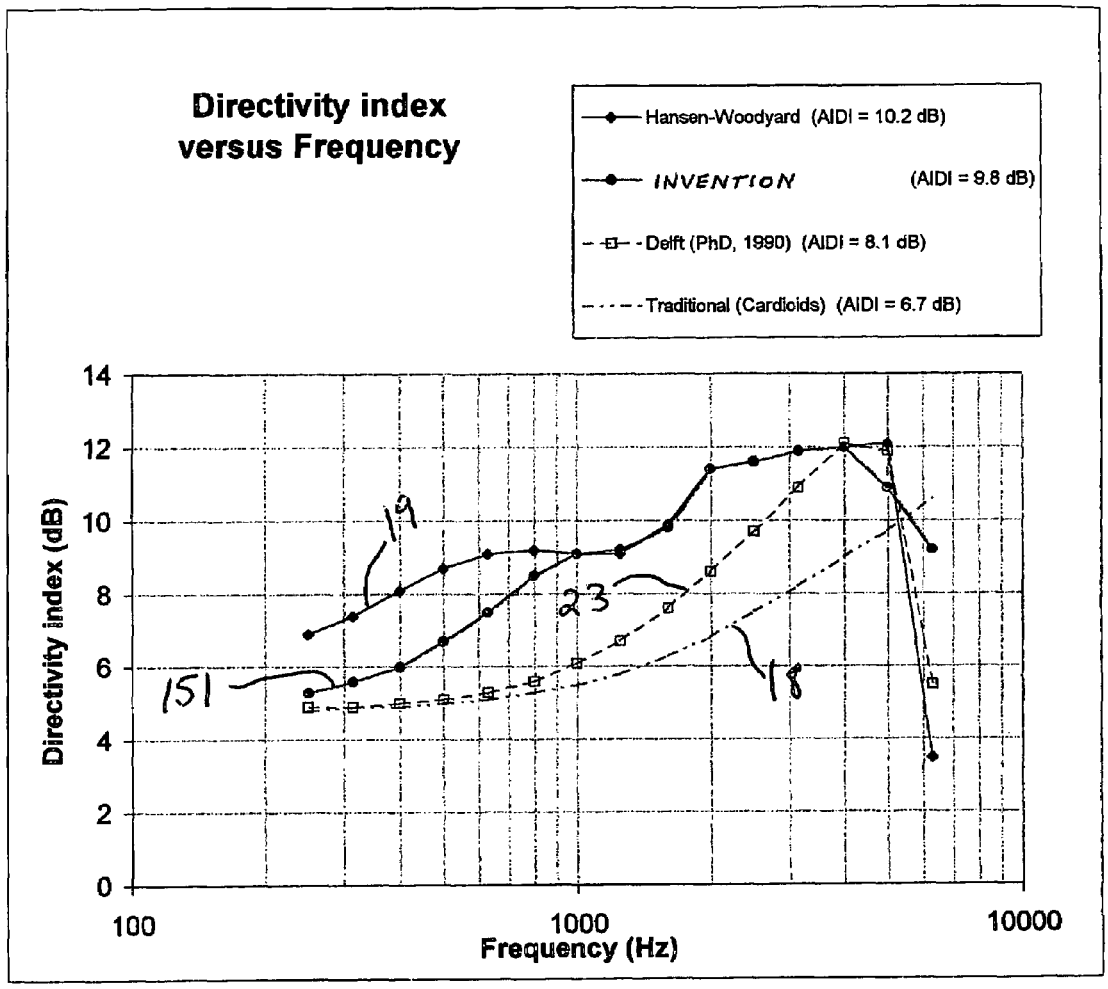
FIG. 9A illustrates a graph of directivity versus frequency for the circuitry of FIG. 8 using the delay cell embodiment of FIG. 7A, as compared to the prior art of FIG. 3.

FIG. 9A illustrates a graph of directivity index versus frequency and AIDI values for the circuitry of FIG. 8 using the delay cell embodiment of FIG. 7A, as compared to the prior art of FIG. 3. As is apparent from curve 151, for the frequency range of most significance for speech discrimination (approximately 500-5000 Hz), the circuitry of FIG. 8 nearly identically tracks the Hansen-Woodyard theoretical optimization (curve 19). In stark contrast to the present invention and as mentioned above, the Delft Thesis (curve 23) and traditional approach (curve 18) fall well short of such theoretical optimization. The circuitry of FIG. 8 (incorporating the circuitry of FIG. 7A) yields an average directivity index of approximately 9.8 dB, much closer to the Hansen-Woodyard theoretical optimization value of 10.2 dB than the prior art Delft thesis (8.1 dB) and traditional approach (6.7 dB).

Figure 9B:
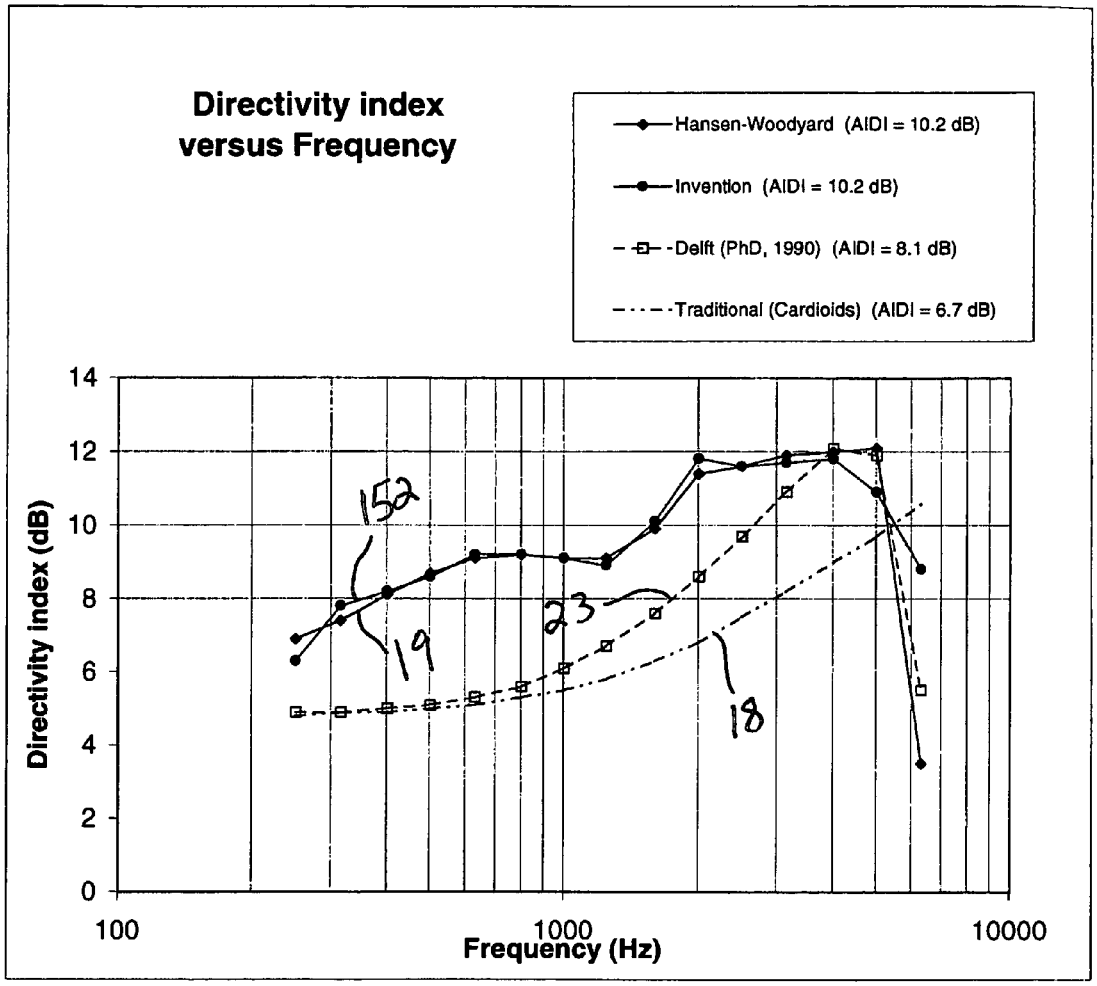
FIG. 9B illustrates a graph of directivity versus frequency for the circuitry of FIG. 8 using the delay cell embodiment of FIG. 7B, as compared to the prior art.

Similarly, FIG. 9B illustrates a graph of directivity versus frequency and AIDI values for the circuitry of FIG. 8, using the delay cell embodiment of FIG. 7B and the delay cell component values in the Hansen-Woodyard column of TABLE I, as compared to the prior art. As is apparent from curve 152, the circuitry of FIG. 8 using the delay cell embodiment of FIG. 7B matches the Hansen-Woodyard theoretical optimization, and at some points is even better than such optimization. This circuitry also provides an AIDI value of 10.2 dB, which is identical to the Hansen-Woodyard theoretical optimization AIDI value.

Figure 9C:
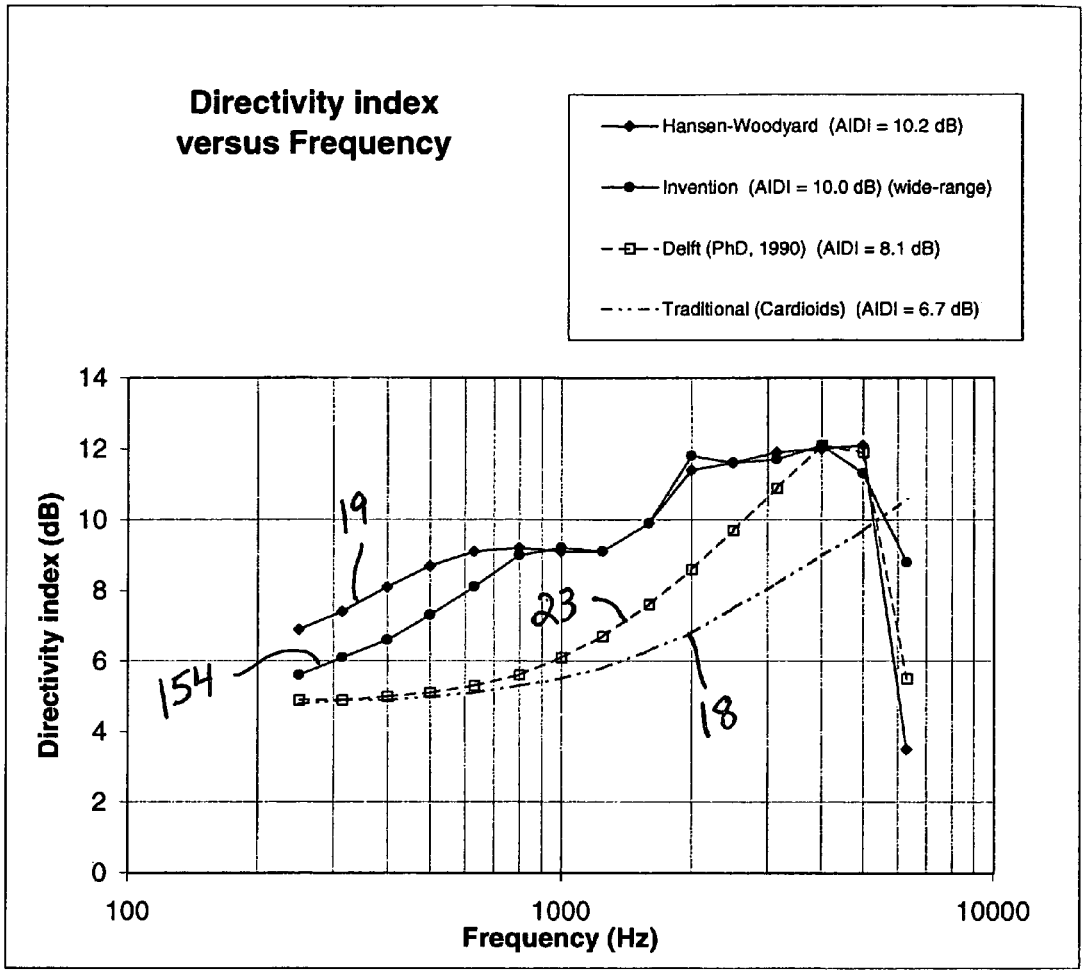
FIG. 9C illustrates a graph of directivity versus frequency for the circuitry of FIG. 8 using the delay cell embodiment of FIG. 7B and wide range RC values for directivity and output, as compared to the prior art.

FIG. 9C likewise illustrates a graph of directivity versus frequency and AIDI values for the circuitry of FIG. 8, using the delay cell embodiment of FIG. 7B and the delay cell component values in the wide-range column of TABLE I, as compared to the prior art. As can be seen from curve 154, the wide-range values produce a lower directivity at low frequencies, but then track the Hansen-Woodyard theoretical optimization for higher frequencies in a frequency range of significance for speech discrimination. The wide-range AIDI value is 10.0 dB, which is very close to the 10.2 dB value produced by the Hansen-Woodyard approach. However, as mentioned above, the wide-range values provide a greater output level than that provided by the Hansen-Woodyard values (TABLE I). Thus, the wide-range values may be desirable when higher output levels are desired, and a lower directivity at low frequencies is acceptable.

Figure 4:
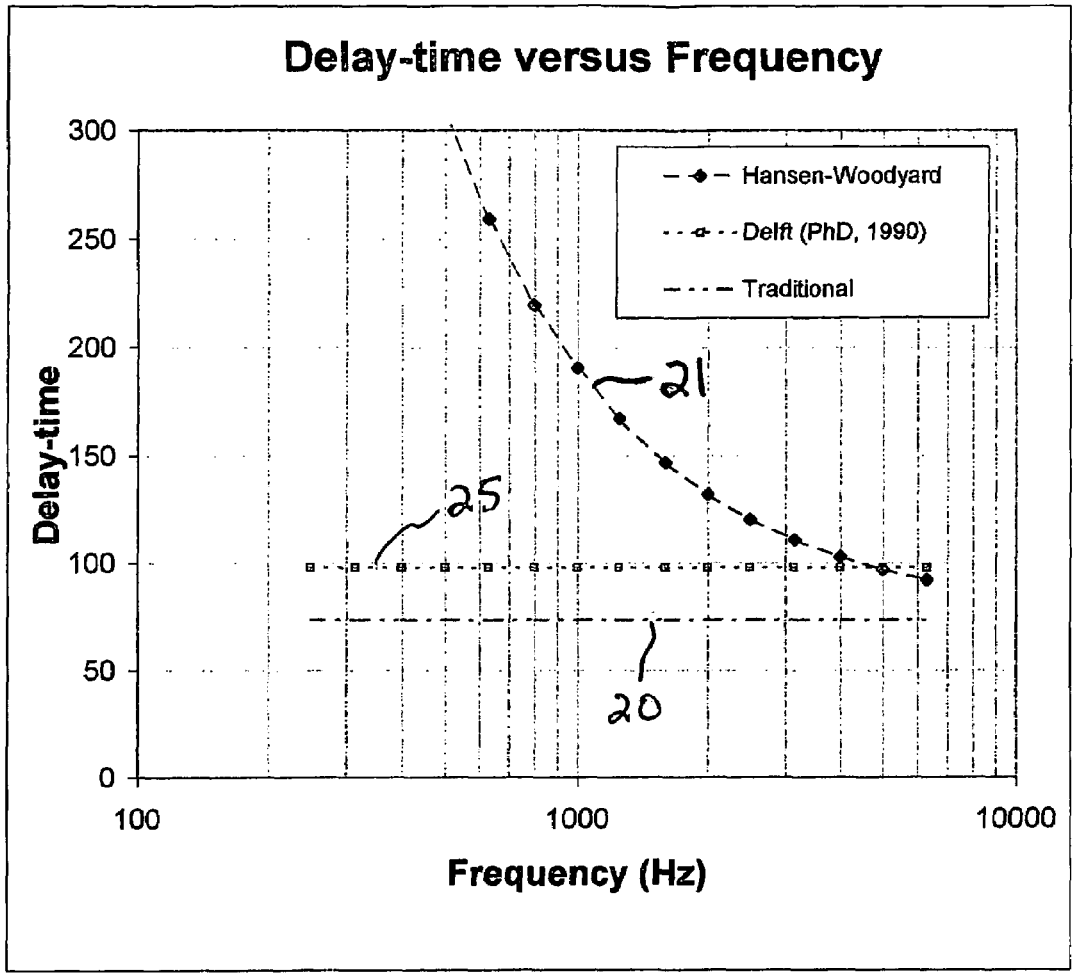
FIG. 4 (PRIOR ART)
FIG. 4 is a graphical plot of delay time versus frequency for a traditional prior art endfire array, a prior art implementation of the Hansen-Woodyard optimization for an endfire array, and the mathematical Hansen-Woodyard optimization for large endfire arrays.
Figure 10A:
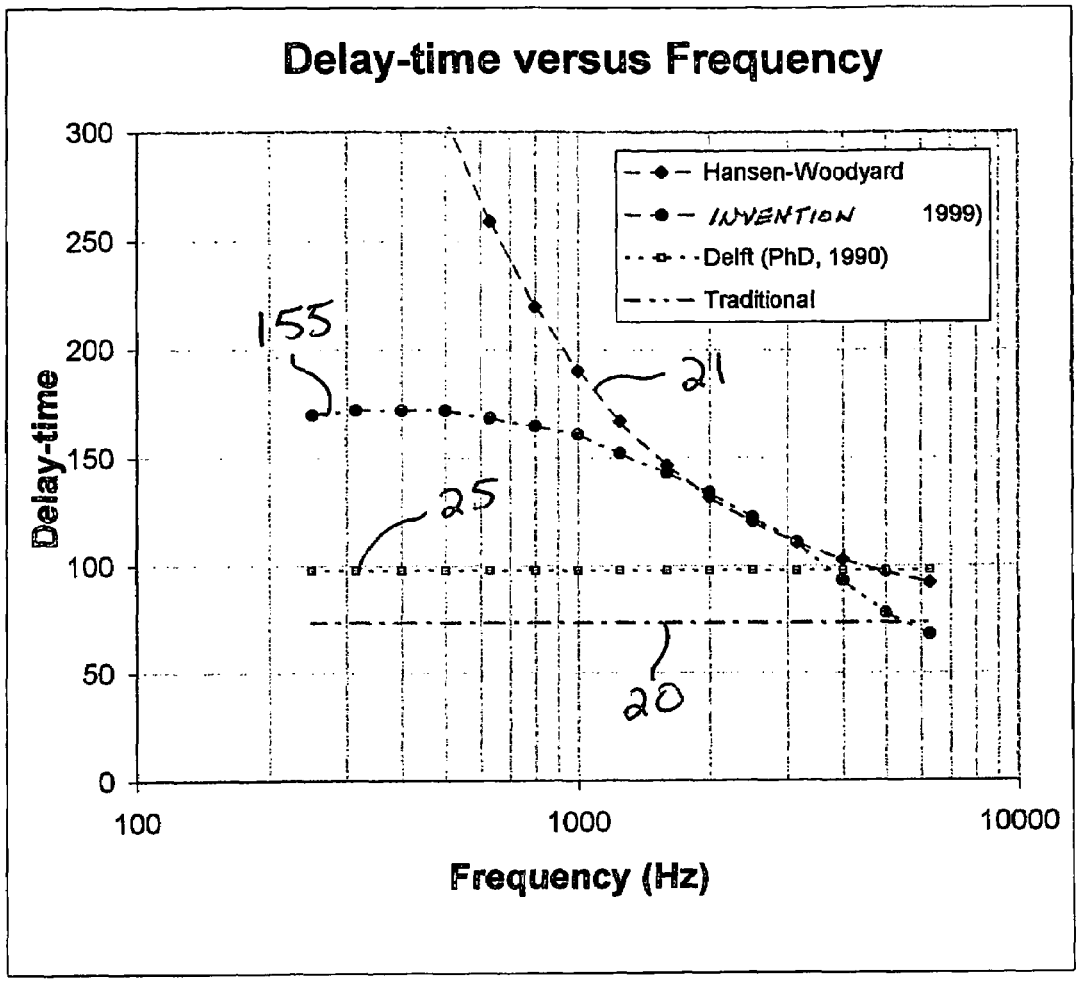
FIG. 10A illustrates a graph of delay time versus frequency for the circuitry of FIG. 8 using the delay cell embodiment of FIG. 7A, as compared to the prior art of FIG. 4.

FIG. 10A illustrates a graph of delay time versus frequency for the circuitry of FIG. 8 using the delay cell embodiment of FIG. 7A, as compared to the prior art of FIG. 4. As can be seen by curve 155, for the frequency range of most significance for speech discrimination, the circuitry of FIG. 8 (incorporating the circuitry of FIG. 7A) nearly identically tracks the Hansen-Woodyard theoretical optimization (curve 21). Again, in stark contrast to the present invention and as mentioned above, the Delft thesis (curve 25) and traditional approach (curve 20) fall well short of such theoretical optimization.

Figure 10B:
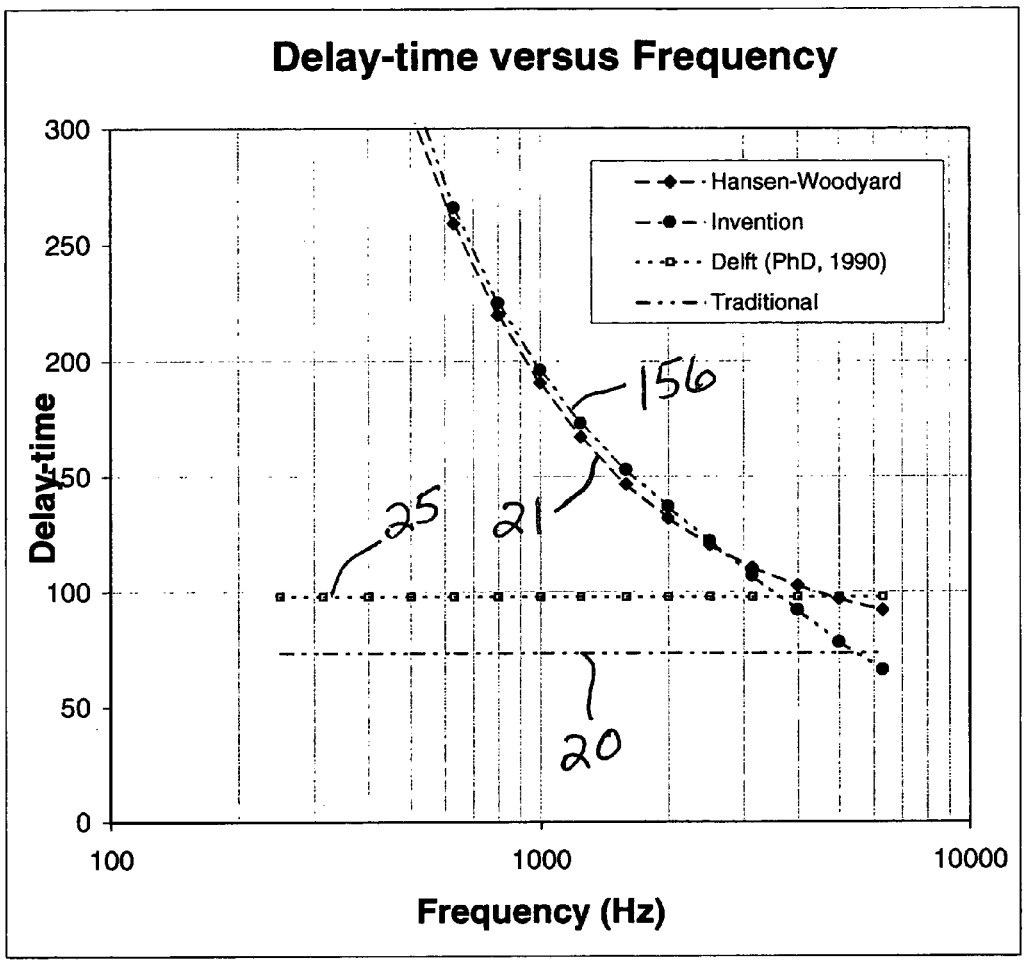
FIG. 10B illustrates a graph of delay time versus frequency for the circuitry of FIG. 8 using the delay cell embodiment of FIG. 7B, as compared to the prior art of FIG. 4.

FIG. 10B illustrates a graph of delay time versus frequency for the circuitry of FIG. 8, using the delay cell embodiment of FIG. 7B and the delay cell component values in the Hansen-Woodyard column of TABLE I, as compared to the prior art of FIG. 4. As can be seen from curve 156, the delay times for this circuitry follow the Hansen-Woodyard theoretical optimization, and are even longer at lower frequencies.

Figure 10C:
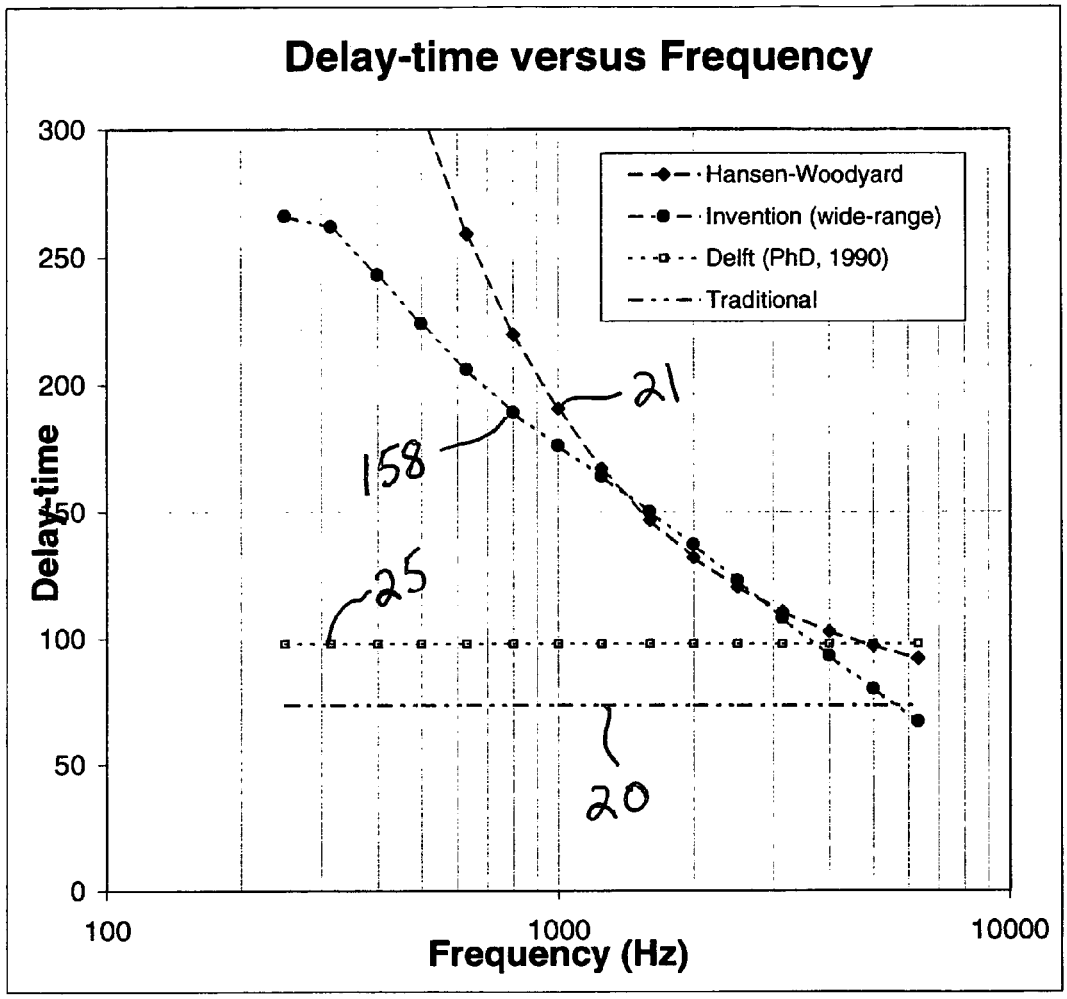
FIG. 10C illustrates a graph of delay time versus frequency for the circuitry of FIG. 8 using the delay cell embodiment of FIG. 7B and wide range RC values for directivity and output, as compared to the prior art of FIG. 4.

Similarly, FIG. 10C illustrates a graph of delay time versus frequency for the circuitry of FIG. 8, using the delay cell embodiment of FIG. 7B and the delay cell component values in the wide-range column of TABLE I, as compared to the prior art. Curve 158 illustrates the shorter delay times at lower frequencies that result from the wide-range component values.

As mentioned above, the Hansen-Woodyard theoretical optimization was developed using large arrays (i.e., where the array length is approximately ten times the wavelength of transmission). Because hearing aid applications involve much smaller arrays (i.e., where the length is less than or equal to the wavelength), a new theoretical optimization was developed to improve over the Hansen-Woodyard theoretical optimization. We have found that the Hansen-Woodyard optimization set forth in the Delft thesis and listed above can be even further improved for short arrays by applying the following frequency dependent correction factor:

$$\tau_{m,new}=\tau_m c(f), \text{ where } c(f)=1.1+0.3\log(f/1000)$$

This formula is the mean for four, five, or six microphones in an array.

Figure 11A:
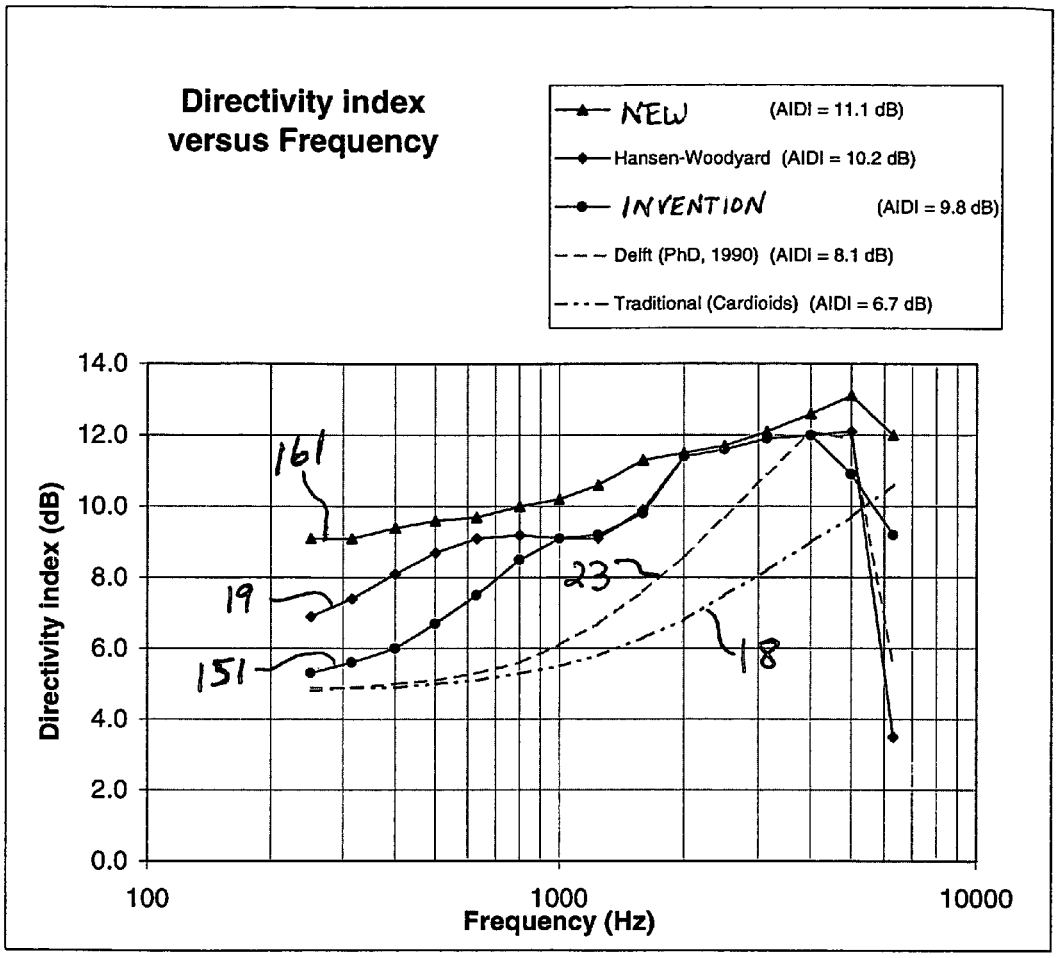
FIG. 11A illustrates a graph of directivity versus frequency for a novel mathematical optimization for short endfire arrays, as compared to the curves of FIG. 9A.

FIG. 11A illustrates a graph of directivity versus frequency similar to FIG. 9A, but including the novel theoretical computed optimization plotted as curve 161. As can be seen, this novel theoretical optimization offers a significant improvement over the Hansen-Woodyard optimization, providing an AIDI of 11.1 dB (compared to 10.2 dB for Hansen-Woodyard). Curve 161 was computed for hypercardioid microphones, while curve 19 was computed for dipole microphones. Curve 151 resulted regardless of whether hypercardioids or dipole microphones were used.

Figure 11B:
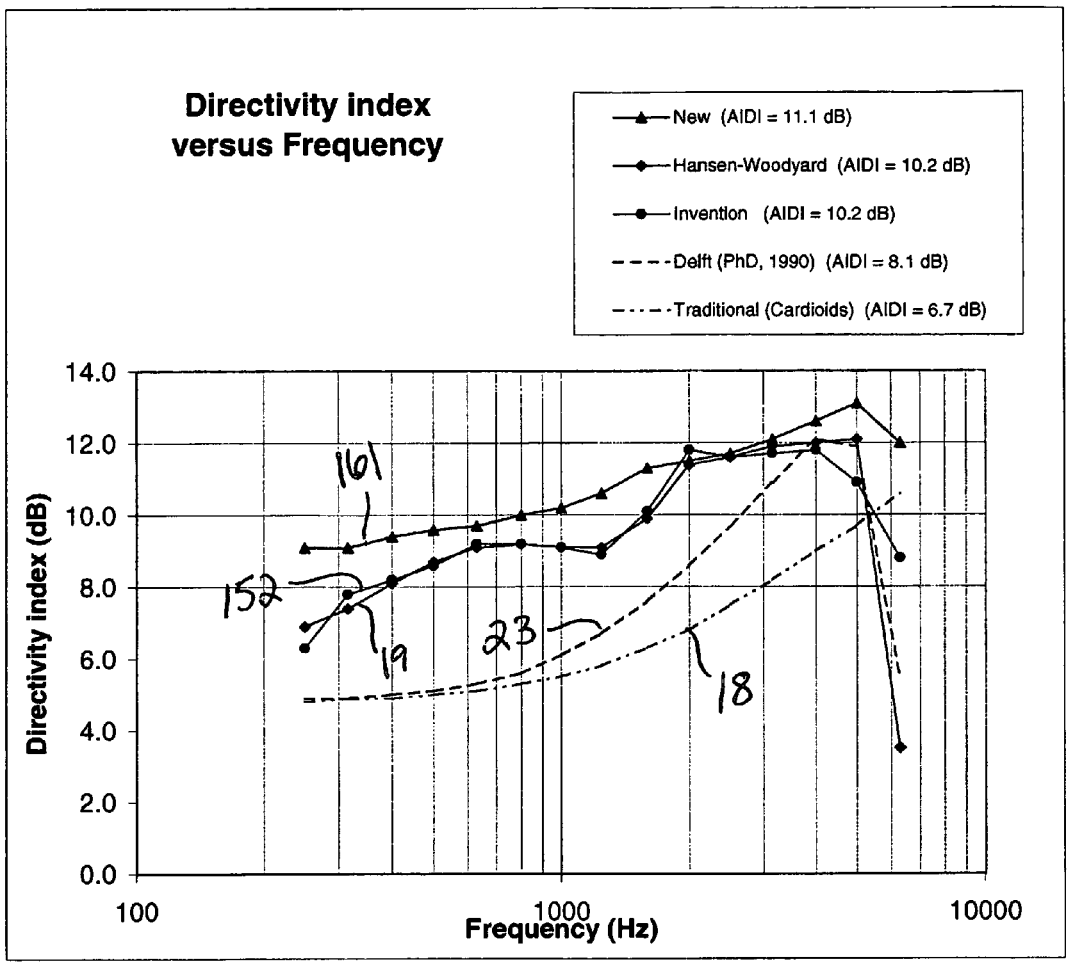
FIG. 11B illustrates a graph of directivity versus frequency for a novel mathematical optimization for short endfire arrays, as compared to the curves of FIG. 9B.

Similarly, FIG. 11B illustrates a graph of directivity versus frequency for the novel mathematical optimization for short endfire arrays, as compared to the curves of FIG. 9B.

Figure 12A:
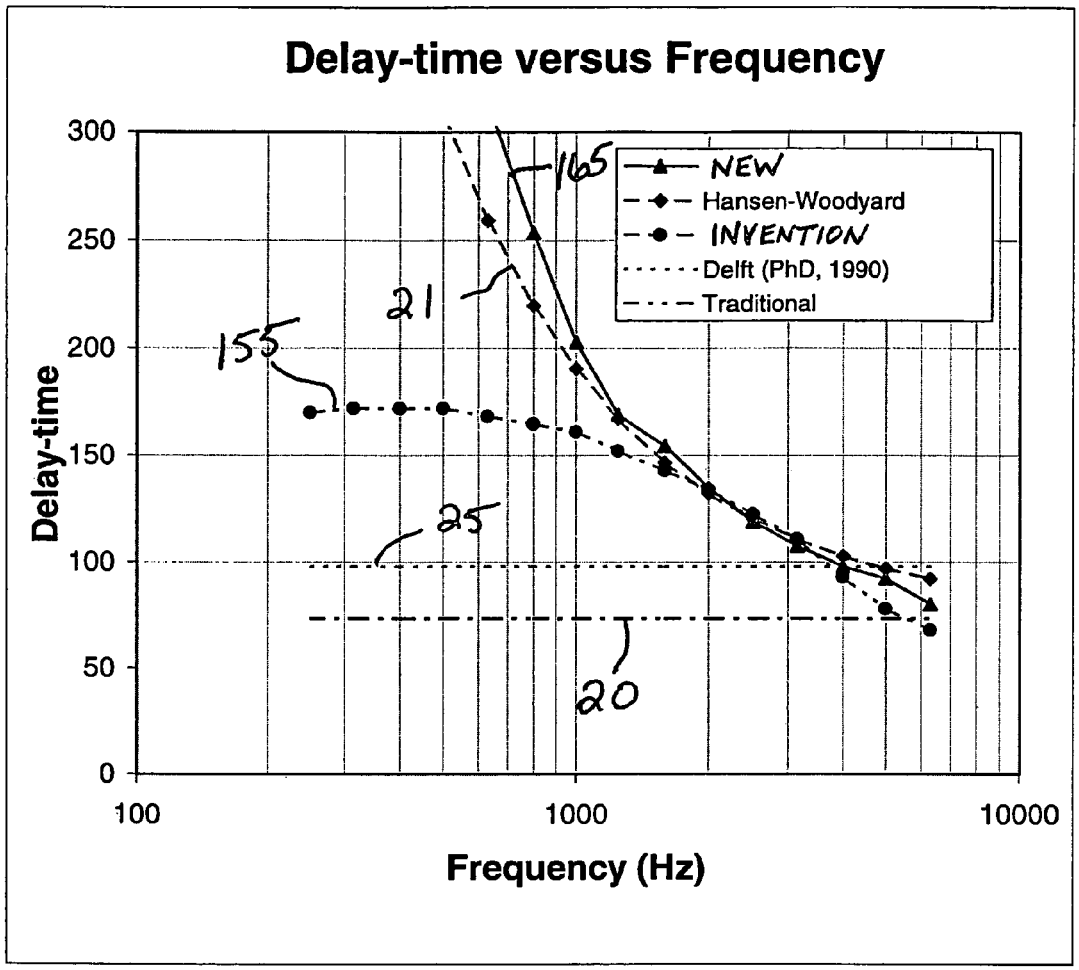
FIG. 12A illustrates a graph of delay time versus frequency for the novel mathematical optimization for short endfire arrays, as compared to the curves of FIG. 10A.

FIG. 12A illustrates a graph of delay time versus frequency similar to FIG. 10A, but including the new theoretical computed optimization plotted as curve 165. Again, as can be seen, this new theoretical optimization is an improvement over the Hansen-Woodyard optimization. The values above 3000 Hz computed using the new optimization are lower than the Hansen-Woodyard computed optimization values, but are higher for frequencies below 1000 Hz.

Figure 12B:
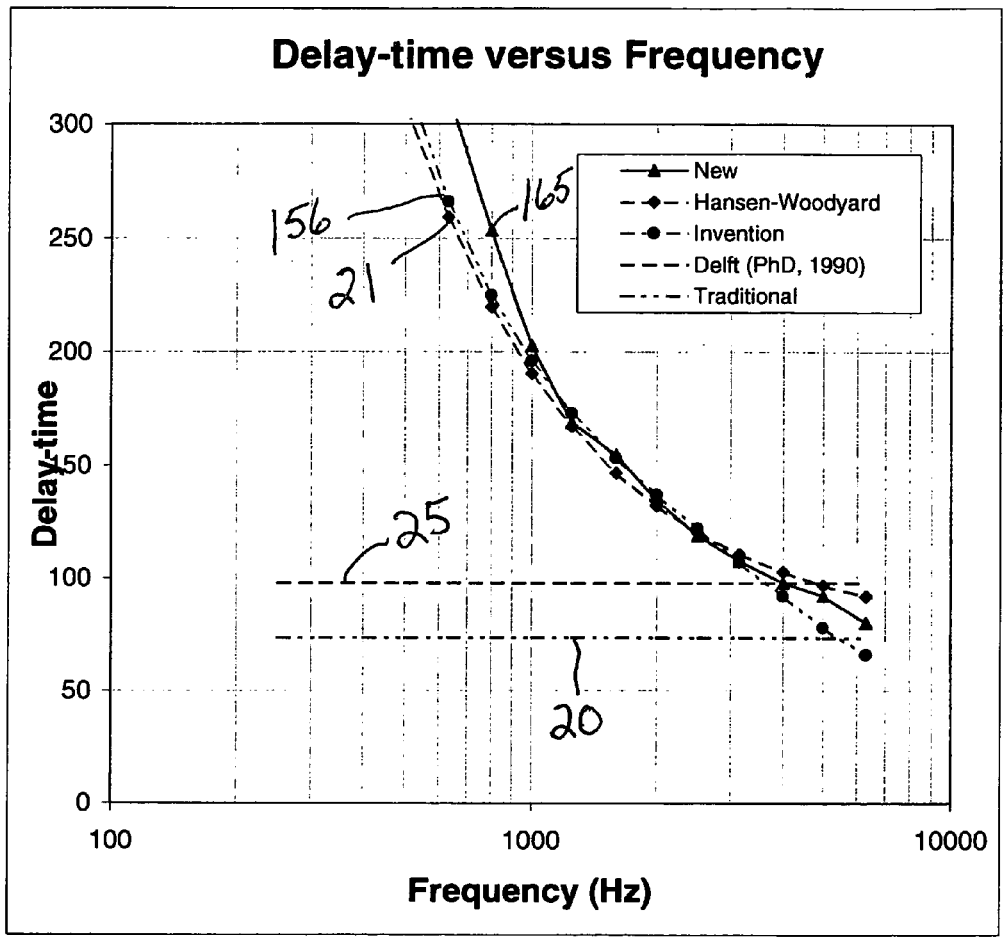
FIG. 12B illustrates a graph of delay time versus frequency for the novel mathematical optimization for short endfire arrays, as compared to the curves of FIG. 10B.

Similarly, FIG. 12B illustrates a graph of delay time versus frequency for the novel mathematical optimization for short endfire arrays, as compared to the curves of FIG. 10B.

Figure 13:
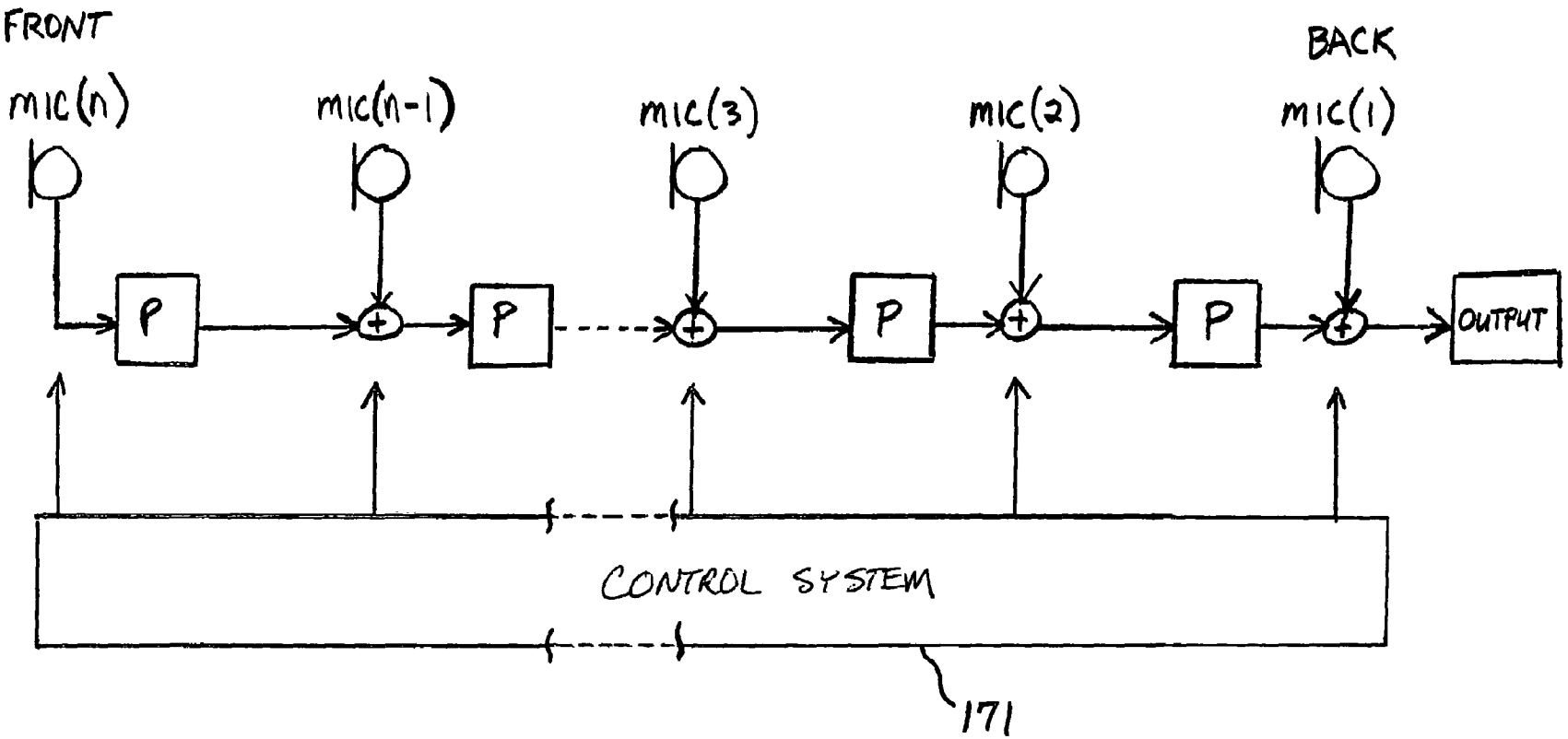
FIG. 13 is a block diagram of a microphone array control system according to the present invention.
Figure 14A:
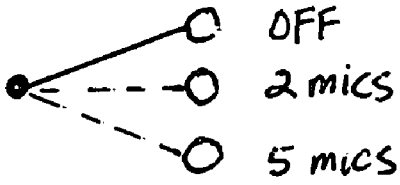
FIGS. 14*a*, 14*b*, and 14*c* illustrate three discreet switch embodiments for the control system of FIG. 13.
Figure 14B:
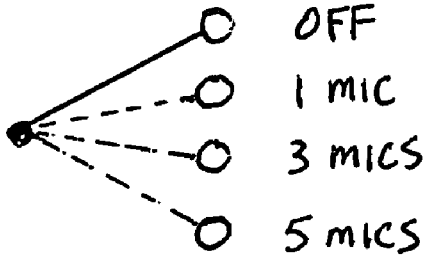
Figure 14C:
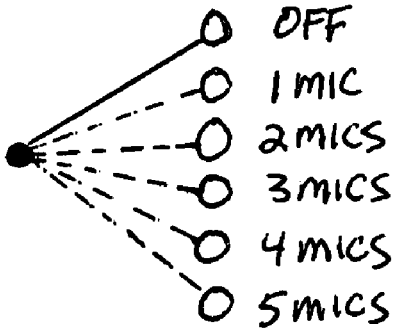

FIG. 13 is a block diagram of a microphone array control system according to the present invention. The control system 171 enables a user to select the directivity of the microphone array depending on the sound level in a given environment. For example, if a room is particularly noisy, a user may desire to use all n microphones, or if the room is not noisy at all, the user may decide to use only a single microphone or shut off the array system. The control system 171 may be configured as a discrete switch, enabling the user to select or deselect individual or combinations of microphones. For example, as shown in FIG. 14*a*, for a five-microphone array, the discrete switch may provide a three-step adjustment where zero, two, or five microphones can be selected. The discrete switch might instead provide, for example, a four-step adjustment where zero, one, three, or five microphones are selected, as shown in FIG. 14*b*. Or, as shown in FIG. 14*c*, a six-step adjustment may be provided where zero, one, two, three, four, or all five of the microphones are selected.

Figure 15:
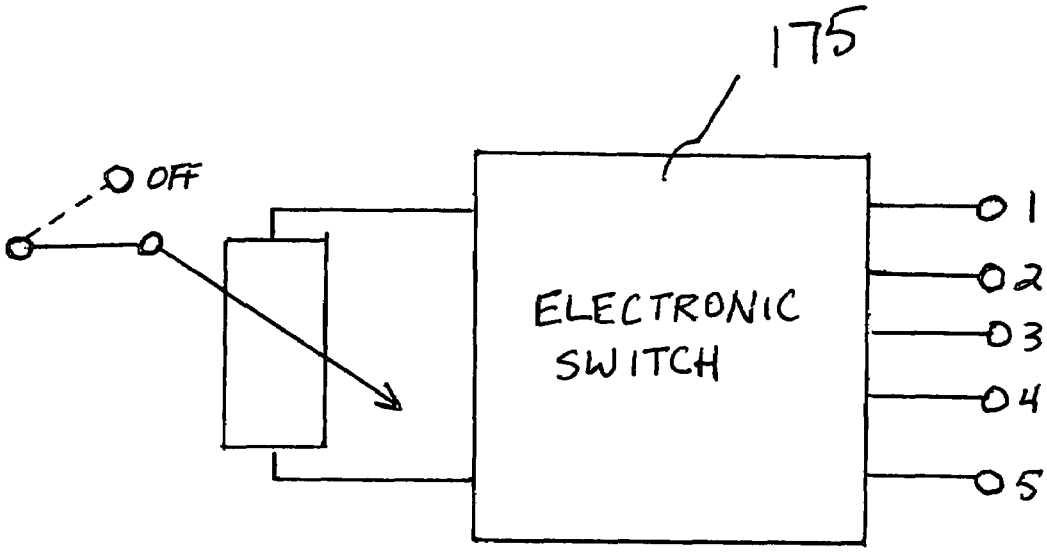
FIG. 15 illustrates an electronic switch embodiment for the control system of FIG. 13.

The control system 171 may also be a discrete fader implemented by an electronic switch 175 as shown in FIG. 15. The directivity, therefore, could be controlled by a user like the volume of a radio.

Figure 16A:
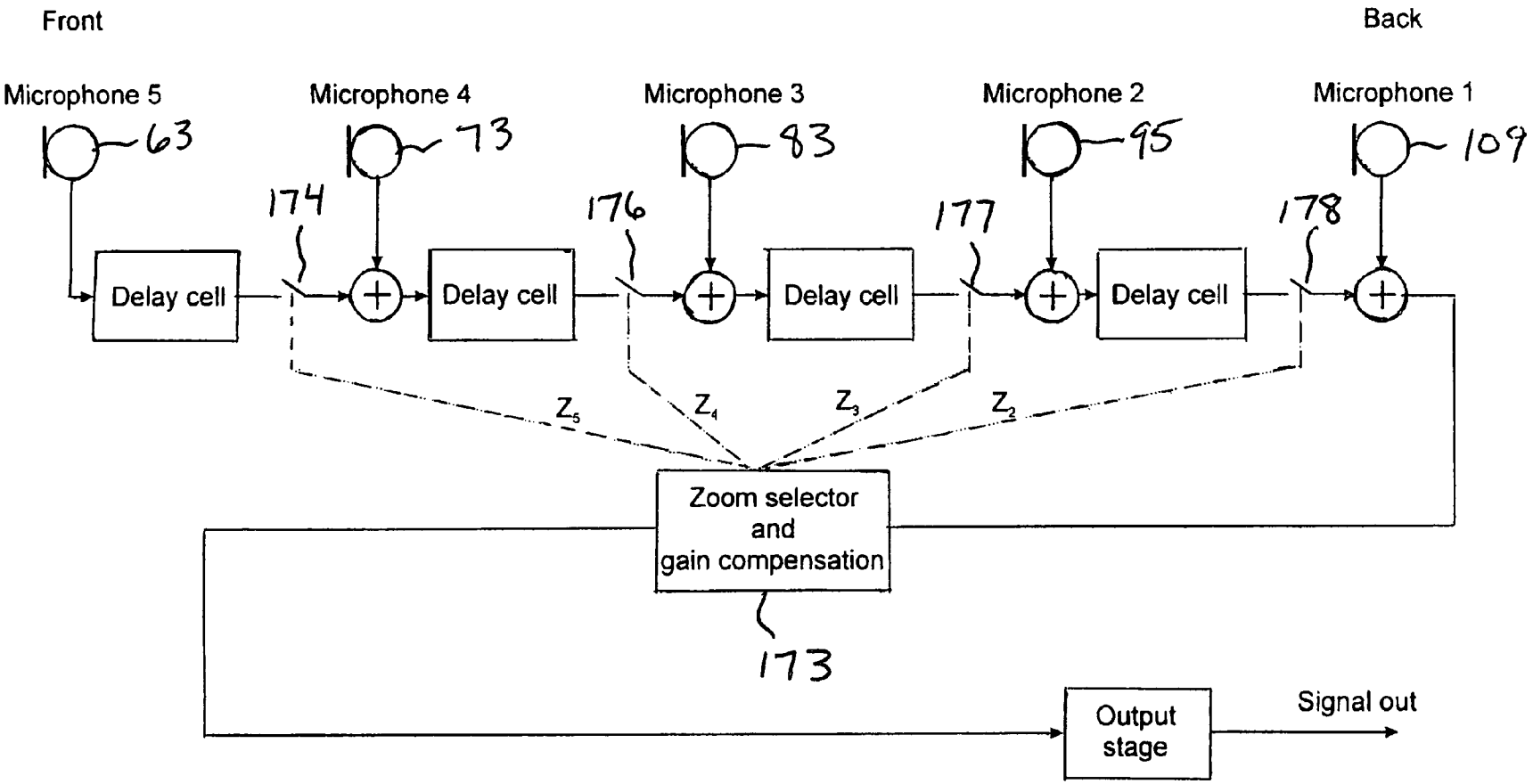
FIG. 16*a* illustrates one embodiment of the microphone array control system of FIG. 13 used in the five microphone endfire array system of FIG. 6.

FIG. 16*a* illustrates one embodiment of the microphone array control system of FIG. 13. FIG. 16*a* incorporates a zoom selector and gain compensation block 173 in the microphone array system of FIG. 6. The block 173 enables the microphones 63, 73, 83, and 95 to be selected or deselected via switches 174, 176, 177, and 178, respectively. The block 173 is also used to make the sensitivity adjustments for each configuration of microphone(s) selected.

Figure 16B:
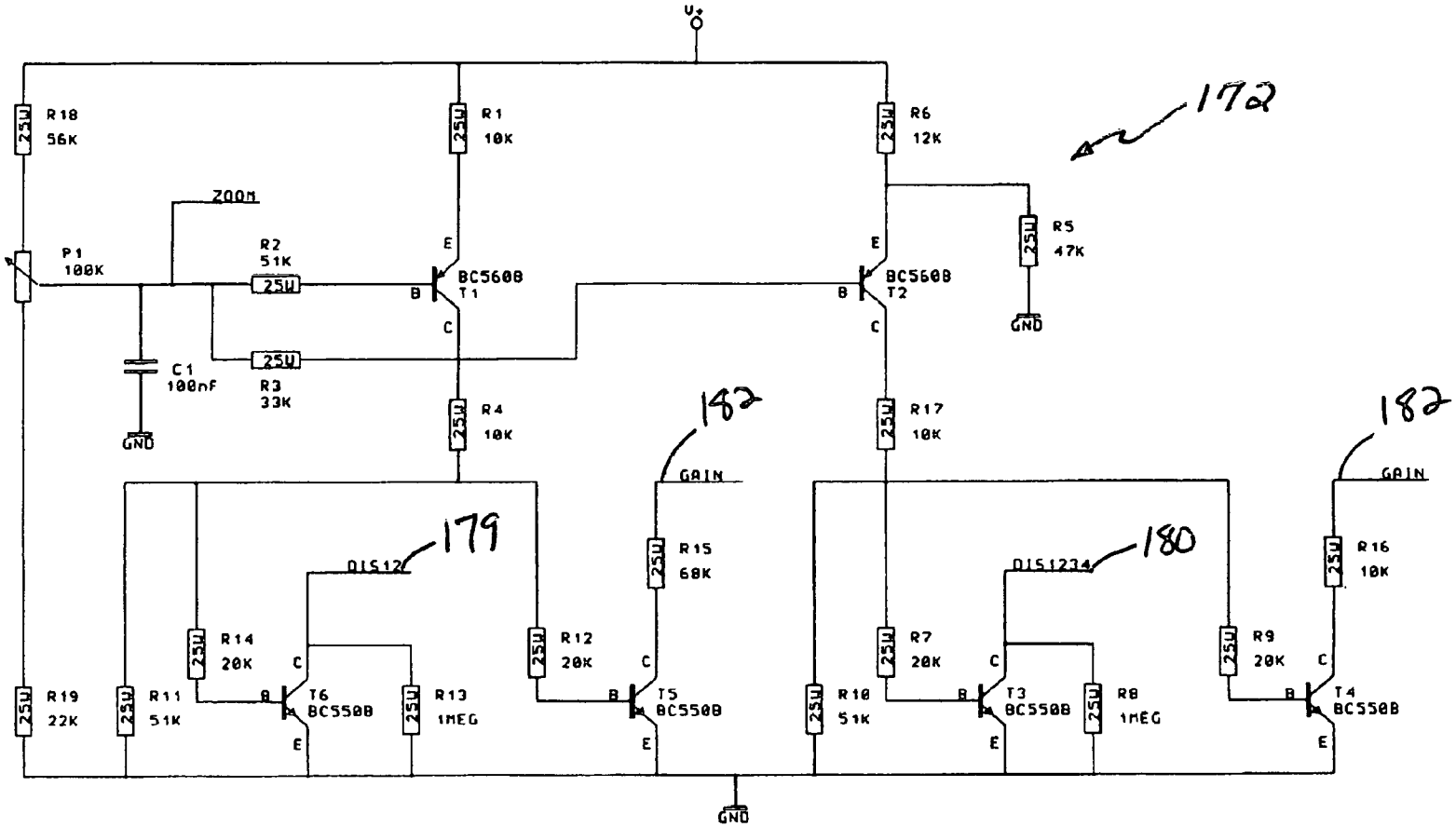
FIG. 16*b* is one embodiment of detailed circuitry for the control system embodiment of FIG. 16*a*.

FIG. 16*b* illustrates circuitry 172 for one embodiment of the zoom selector and gain compensation block 173 of FIG. 16*a*. Circuitry 172 may be used in conjunction with the circuitry 140 of FIG. 8. Circuitry 172 connects to circuitry 140 at points 179, 180, and 182 (See FIGS. 8 and 16*b*), and provides a three-step selection of microphones. More specifically, circuitry 172 selectively shorts out microphones 63, 73, 83 and/or 95 of FIG. 8. Referring to FIG. 8, capacitor 184 is used by circuitry 172 to short microphones 63 and 73, so that only microphones 83, 95, and 109 are operating. Capacitor 186 is used by circuitry 172 to short microphones 63, 73, 83, and 95, so that only microphone 109 is operating. In other words, circuitry 172 enables selective operation of one, three, or five microphones. The gain control 182 of circuitry 172 is used to adjust the sensitivity of output signal 115 depending upon whether one, three, or five microphones is/are selected.

Figure 17:
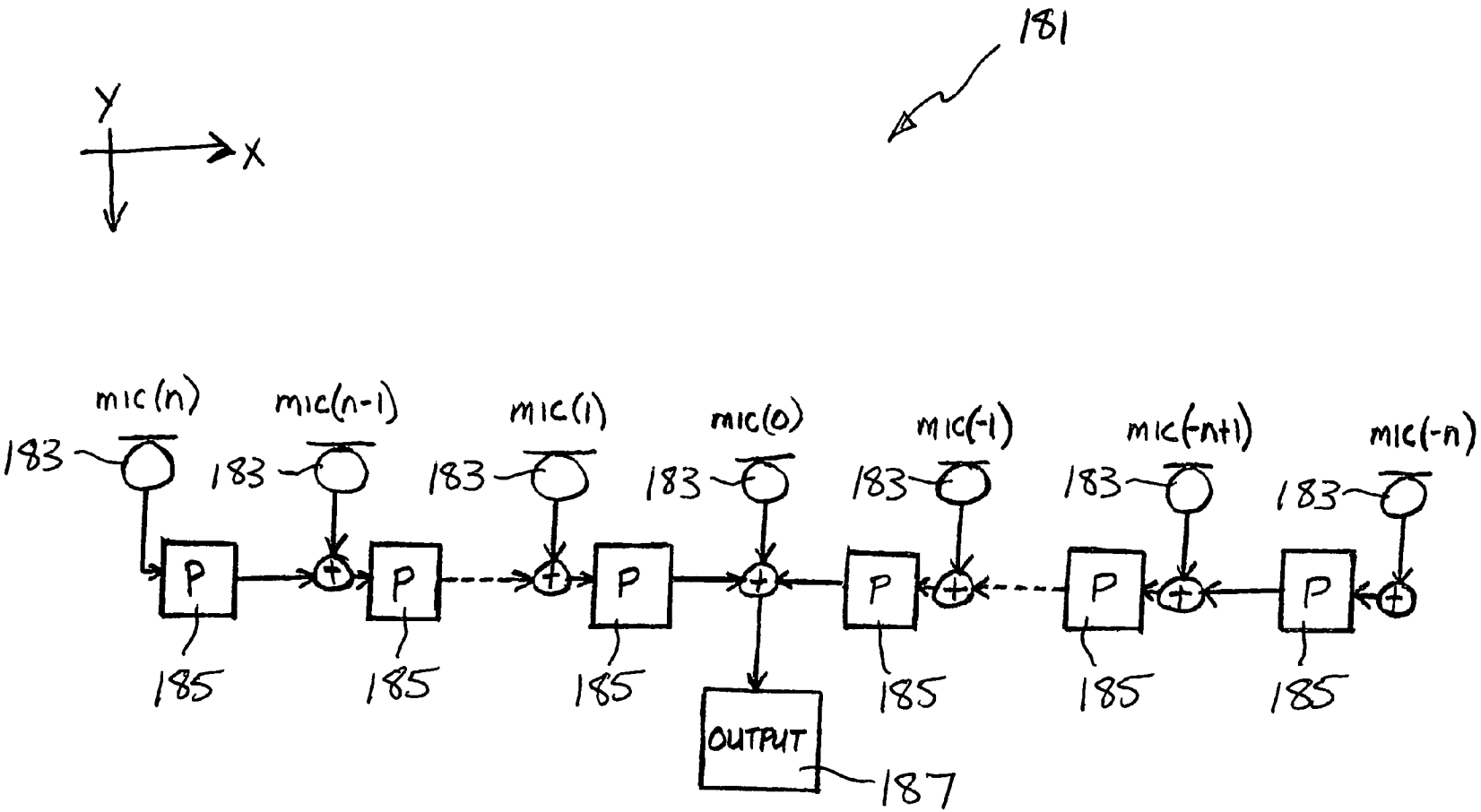
FIG. 17 is a block diagram of a broadside microphone array system according to the present invention.

FIG. 17 is a block diagram of a broadside microphone array system 181 according to the present invention. The microphone array system 181 includes a plurality of microphones 183 aligned along an axis x. Each microphone 183 generates a signal from sound typically impinging along an axis y, and each signal generated is transmitted to a processor 185. Each processed signal is then added to produce an amplified output signal 187. No delay is required because sound reaches each microphone 183 at essentially the same time from the desired y-direction.

The broadside microphone array system 181 of FIG. 17 is a substantial improvement over that of the prior art found in FIG. 1*a*. For example, the array system 181 of the present invention requires much less circuitry than that of the prior art. As can be seen in FIG. 1*a*, for a seven-microphone array, the prior art required seven different signal lines. The broadside microphone array of the present invention requires only a single signal line. In addition, the present invention enables the array to be expanded or contracted by the simple addition or subtraction of microphones in a daisy chain manner, without requiring any rewiring. Additionally, equal processors can be used.

Figure 18:
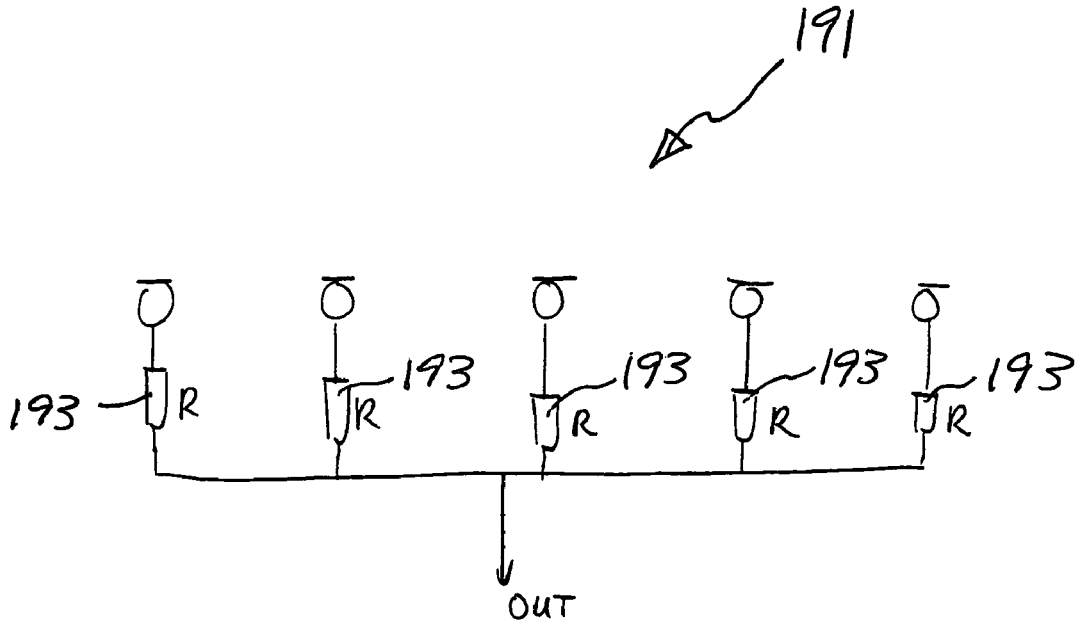
FIG. 18 illustrates a five microphone broadside array system built in accordance with the present invention.

In one embodiment, the broadside microphone array system 181 of FIG. 17 may, for example, be implemented using resistors as shown in FIG. 18. FIG. 18 illustrates a five-microphone broadside array 191. Resistors 193 provide the processing and addition functions of the array system. As mentioned above, the resistors may be of equal value. This embodiment requires a minimum of circuitry, which in turn enables smaller hearing assistance devices to be produced.

Figure 19:
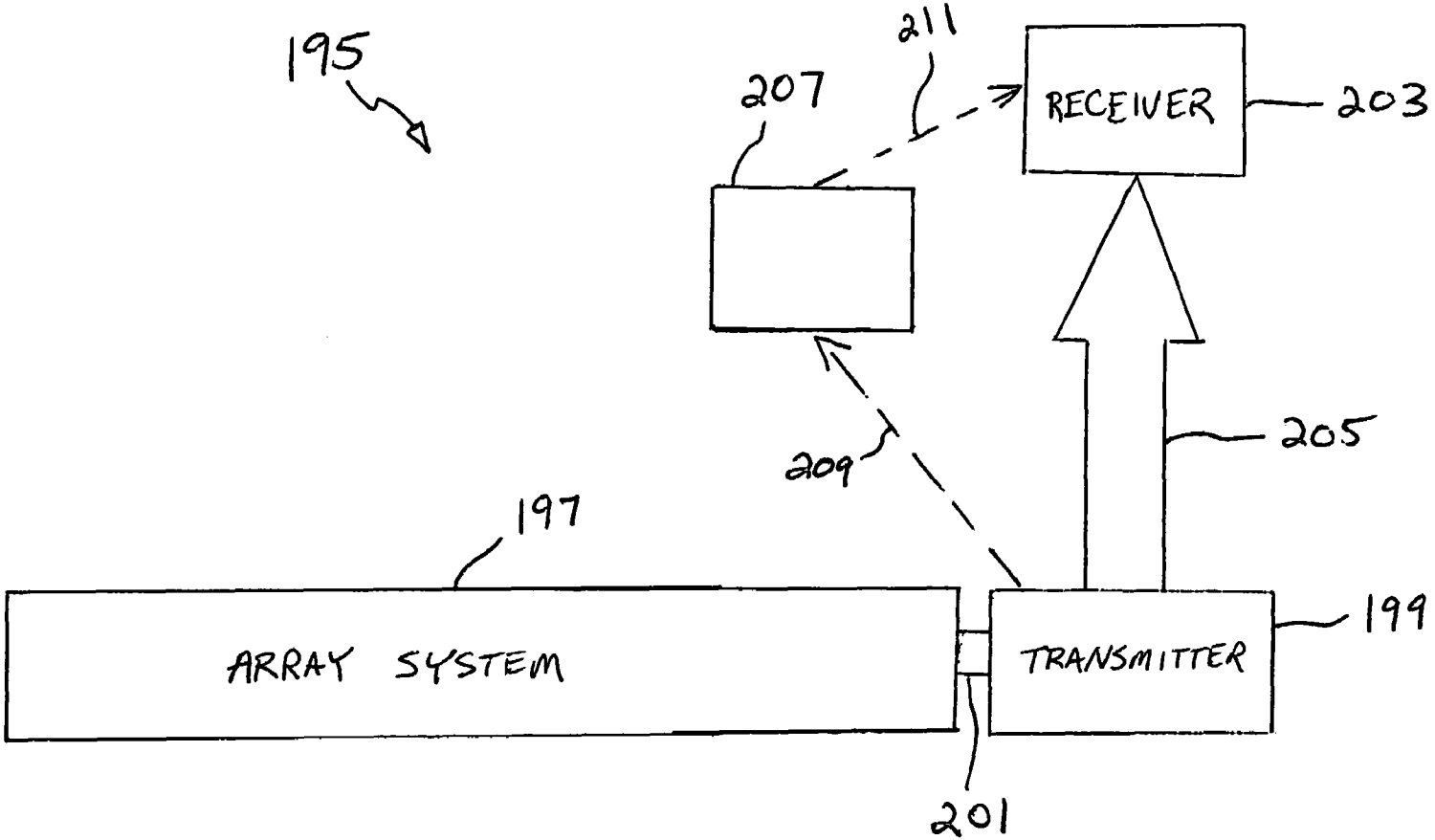
FIG. 19 illustrates a transmission system according to the present invention for use with microphone arrays of the present invention.

FIG. 19 illustrates a transmission system 195 according to the present invention for use with microphone arrays of the present invention. An array system 197 is coupled to a transmitter 199 via link 201. In one embodiment, the array and transmitter are housed as separate units. In another embodiment, they are housed in a single unit. The output signal of the array system is transmitted to the transmitter 199, which in turn communicates the signal to a receiver 203 via communication link 205. The receiver 203 is generally located on or in a behind the ear (BTE) or an in the ear (ITE) hearing aid of a user. The receiver may also be located in a pair of earphones or headphones.

Communication link 205 may, for example, be simply a communication cable that links the transmitter and receiver. The communication link 205 may also be wireless, however. For example, the transmitter 199 may include an induction loop, an induction coil, or TMX transmission (of Phonic Ear Corporation), and the receiver 203 may include an induction coil. Alternatively, the transmitter 199 may be a TMX transmitter and the receiver 203 a TMX receiver, or the transmitter 199 and receiver 203 may communicate via radio frequency transmissions (e.g., FM). Transmitter 199 and communication link 205 may also provide acoustical coupling of the array signal with the receiver by use of a transceiver and a tube.

In another embodiment, the transmission system includes a junction box or station 207. In this embodiment, the transmitter 199 may communicate via RF to the station 207 via link 209. The station 207 converts the received signal and communicates via TMX to the receiver 203 via link 211.

Figure 20:
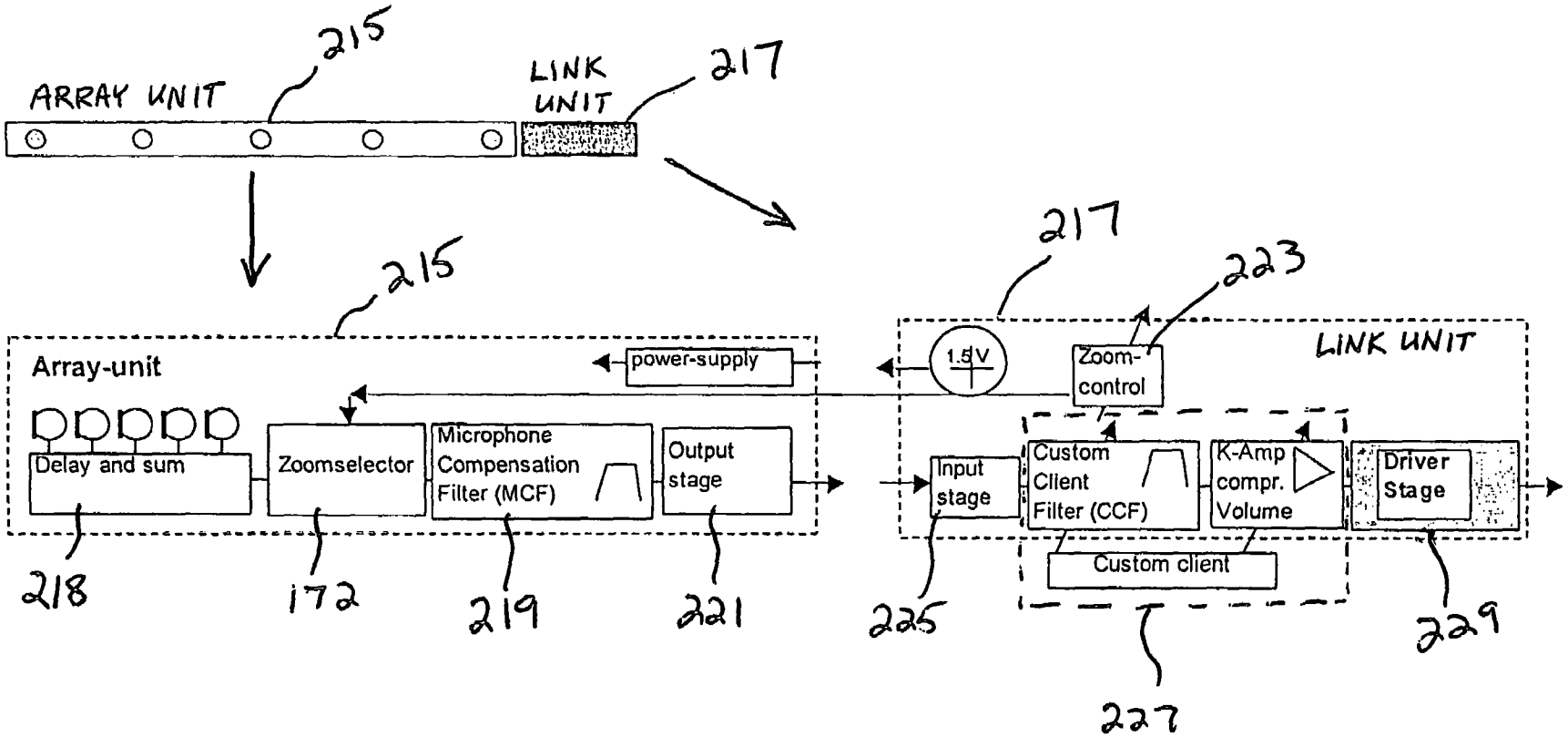
FIG. 20 illustrates one embodiment of a portion of the transmission system of FIG. 19 according to the present invention.

FIG. 20 illustrates one embodiment of a portion of the transmission system of FIG. 19 built in accordance with the present invention. The array system 197 and a transmitter 199 of FIG. 19 generally comprise an array unit 215 and a link unit 217, respectively, in FIG. 20. The array unit 215 includes, for example, the microphone array circuitry 140 of FIG. 8 (see reference numbers 218, 219, and 221) as well as the zoom selector circuitry 172 of FIG. 16*b*.

Link unit 217 includes a zoom-control 223 for manually or automatically selecting the microphones using the circuitry 172, an input stage 225, and an optional programmable signal processing block 227. The circuitry in block 227 is used to adapt the system to different hearing aid manufacturer's designs. Finally, link unit 217 includes a driver stage 229. As mentioned above, the driver stage can transmit signals via any number of methods, including, for example, TMX-transmission, direct wire (e.g., auxiliary, headphones, BTE style induction plate), built-in induction coil, acoustical coupling (transceiver with tube), or RF transmission.

The link unit 217 may removably plug into array unit 215 to form a single unit. Such a configuration enables a user to select the type of output stage desired by simply plugging in the appropriate link unit. Alternatively, the array-unit and link unit can be housed as a single unit.

The array system 197 and transmitter 199 of FIG. 19 may be implemented in a number of devices for use by hearing impaired individuals. For example, they may be mounted as part of the sidepiece or arm of a pair of spectacles, where the transmitter would communicate with a hearing aid. Alternatively, they may be coupled to a BTE hearing aid, where the transmitter would communicate with the hearing aid. Such configurations would also enable binaural use, i.e., two transmission systems could be used, one on each side of the spectacles/BTE for each ear. Alternatively, a broadside array could be used and the array system and transmitter could be mounted on the front of a pair of spectacles. In any case, the user would then simply need to face the direction of the person with whom communication is desired.

In another embodiment, the array system 197 and transmitter 199 could be incorporated into a pen-type device that could be either mounted or rested on a table, for example, or hand-held. The user would simply point the device in the direction of the person with whom communication is desired. Other configurations are also contemplated, such as, for example, mounting of the system on a neckloop or headband. In general, the system may be used in any application that uses or would benefit from a directional microphone.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A microphone system comprising:

a plurality of microphones aligned in an array configured to generate a plurality of electrical signals from sound energy received;

a plurality of summation points configured to add the plurality of electrical signals to generate an output signal;

a plurality of delay cells comprising:

a frequency dependent delay circuit configured to respectively delay all but one of the plurality of electrical signals, and a buffering high impedance fixed gain amplifier configured to maintain direct current levels in a signal path; and an output cell comprising:

an amplifier configured to amplify the generated output signal, and a microphone compensation filter configured to compensate for a frequency response of the plurality of microphones.

2. A microphone system comprising:

a plurality of microphones aligned in an array configured to generate a plurality of electrical signals from sound energy received;

a further microphone aligned in the array configured to generate further electrical signal from sound energy received;

a plurality of delay cells associated with the plurality of microphones configured to delay the plurality of electrical signals;

a plurality of summation points configured to add the plurality of delayed electrical signals and the further electrical signal to generate an output signal; and an output cell comprising an amplifier configured to amplify the generated output signal and a microphone compensation filter configured to compensate for a frequency response of the plurality of microphones, wherein each of the plurality of delay cells comprises a buffering high impedance fixed gain amplifier configured to maintain direct current levels in a signal path.

3. A microphone system comprising:

a plurality of microphones aligned in an array configured to generate a plurality of electrical signals from sound energy received;

a further microphone aligned in the array configured to generate a further electrical signal from sound energy received;

a plurality of delay cells associated with the plurality of microphones configured to delay the plurality of electrical signals;

a plurality of summation points configured to add the plurality of delayed electrical signals and the further electrical signal to generate an output signal, the system producing an average directivity index of at least approximately 9.8 dB; and an output cell comprising an amplifier configured to amplify the generated output signal and a microphone compensation filter configured to compensate for a frequency response of the plurality of microphones, wherein each of the plurality of delay cells comprises a buffering high impedance fixed gain amplifier configured to maintain direct current levels in a signal path.

4. The microphone system of claim 3 wherein the system produces an average directivity index of approximately 10.0 dB.

5. The microphone system of claim 3 wherein the system produces an average directivity index of approximately 10.2 dB.

* * * * *